US006900761B2

(12) United States Patent
Durban et al.

(10) Patent No.: US 6,900,761 B2
(45) Date of Patent: May 31, 2005

(54) AUTOMATED PORTABLE REMOTE ROBOTIC TRANSCEIVER WITH DIRECTIONAL ANTENNA

(75) Inventors: Jack P. Durban, Mission Veijo, CA (US); Sean K. Gahan, Fresno, CA (US)

(73) Assignee: Optistreams, Inc., Fresno, CA (US)

( * ) Notice: Subject to any disclaimer, the term of this patent is extended or adjusted under 35 U.S.C. 154(b) by 0 days.

(21) Appl. No.: 10/817,501

(22) Filed: Apr. 2, 2004

(65) Prior Publication Data

US 2004/0239561 A1 Dec. 2, 2004

Related U.S. Application Data

(60) Provisional application No. 60/460,238, filed on Apr. 3, 2003.

(51) Int. Cl.[7] ..... H01Q 3/00
(52) U.S. Cl. ..... 342/359; 342/75
(58) Field of Search ..... 342/74, 75, 359, 342/422; 343/754, 757

(56) References Cited

U.S. PATENT DOCUMENTS

| | | | | |
|---|---|---|---|---|
| 4,263,539 A | | 4/1981 | Barton | |
| 4,675,680 A | | 6/1987 | Mori | |
| 5,089,824 A | * | 2/1992 | Uematsu et al. | 342/359 |
| 5,119,105 A | * | 6/1992 | Ngai et al. | 343/703 |
| 5,166,693 A | | 11/1992 | Nishikawa et al. | |
| 5,592,176 A | | 1/1997 | Vickers | |
| 5,644,318 A | | 7/1997 | Janky et al. | |
| 5,936,570 A | | 8/1999 | Ghazvinian et al. | |
| 6,014,109 A | | 1/2000 | Raby | |
| 6,166,679 A | | 12/2000 | Lemelson et al. | |
| 6,278,861 B1 | | 8/2001 | Ward et al. | |
| 6,307,523 B1 | | 10/2001 | Green | |
| 6,369,755 B1 | | 4/2002 | Nichols | |
| 6,377,211 B1 | | 4/2002 | Heijnen et al. | |
| 6,414,624 B2 | | 7/2002 | Endo | |
| 6,433,736 B1 | | 8/2002 | Timothy et al. | |
| 6,473,025 B2 | | 10/2002 | Stolarczyk et al. | |
| 6,473,035 B2 | | 10/2002 | Fang | |
| 6,529,161 B2 | | 3/2003 | Fukushima | |
| 2001/0006372 A1 | | 7/2001 | Lemelson | |
| 2002/0072389 A1 | | 6/2002 | Ward et al. | |
| 2003/0191568 A1 | | 10/2003 | Breed | |

FOREIGN PATENT DOCUMENTS

| | | |
|---|---|---|
| GB | 2 341 289 A | 8/2000 |
| WO | PCT/GB99/01745 | 12/1999 |

* cited by examiner

*Primary Examiner*—Dao Phan
(74) *Attorney, Agent, or Firm*—Burns & Levinson LLP; Frederick C. Williams; Yan Lan

(57) ABSTRACT

A portable, remote-controlled or automated robotic (capable of operating in an unmanned mode) transceiver using a directional antenna pointing system The system comprises a highly integrated, wireless, self-contained transceiver with robotic antenna pointing and an interface system for satellite, conventional antenna, and radar applications for personal, commercial, and military use.

5 Claims, 25 Drawing Sheets

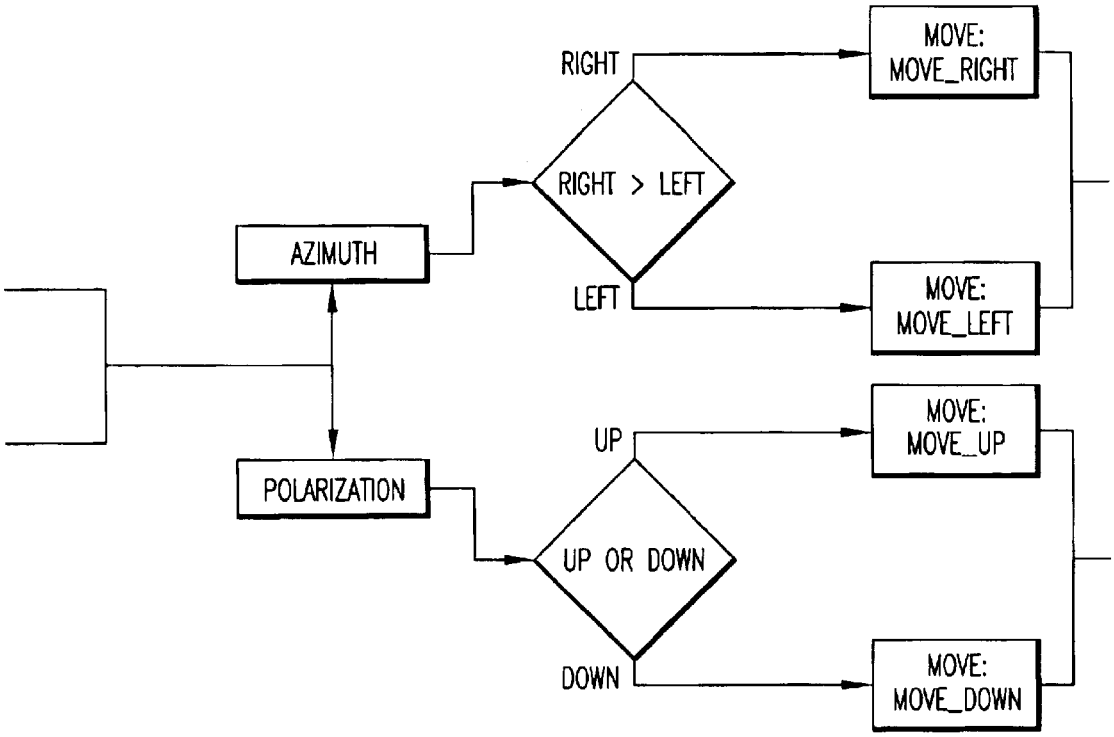
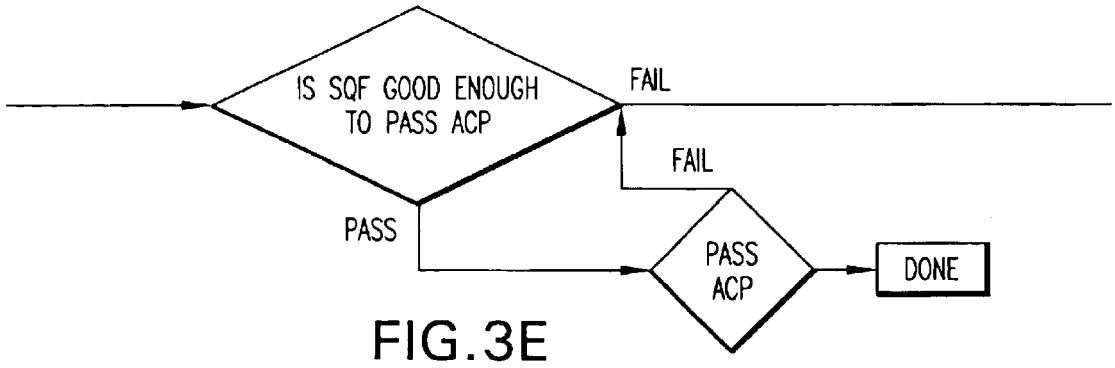
FIG.3E

AUTOMATED PORTABLE REMOTE ROBOTIC TRANSCEIVER WITH DIRECTIONAL ANTENNA

PRIORITY

This application claims priority from U.S. Provisional Patent Application No. 60/460,238 filed Apr. 3, 2003.

FIELD OF THE INVENTION

The present invention relates to apparatus for remote communication using a mobile antenna system. It further relates to a system that enables a remote communications antenna to acquire target transmitting and receiving antennas automatically. More particularly, the invention relates to a portable, optionally manned or unmanned, PC-based communications and telemetry system for receiving and transmitting analog or digital, RF, and modulated voice, picture, or data from land based sources and extra terrestrial satellites. Alternately, this invention is directed toward a wireless self-contained communications interface between a user, sensor, and hand held transceiver or any combination thereof and geostationary satellites.

BACKGROUND OF THE INVENTION

Conventional devices called "mobile satellite mounts" exist for providing mobile or portable satellite-based broadband internet access and entertainment services such as DIRECWAY and DSS. These systems provide at most consumer and commercial grade internet broadband and entertainment services. Moreover, these mobile mounts all require wiring and cabling between a host vehicle and the mobile mount. Also, The requisite device wiring and cabling generally consists of large conductor power wires and inbound and outbound RF carrier coaxial cables. The installation and routing of these wires and cables represent significant effort, time and expense, as well as risk of damage to vehicle exterior and interior structures and panels during and after the installation process. Expensive motor homes, production trucks, and governmental vehicles represent large investments, and drilling holes in roof tops, interior head liners, walls, and cabinetry are high risk modifications exposing the installer to the risk of having to do costly repairs. Also, since these devices are tethered to their host vehicle they lack the ability to be autonomous and self contained systems that could provide many more high utility features.

Accordingly, it is an object of the present invention to provide an improved mobile satellite mount. It is a further object of this invention to provide a free standing system that could also provide telemetry and security functions in conjunction with conventional satellite services. It is a further object of this invention to provide a portable mobile satellite mount. It is yet a further object of this invention to provide a mobile mount that is removably mounted on a vehicle or stationary site without exposing the vehicle or stationary site to costly modifications.

SUMMARY OF THE INVENTION

The present invention is a highly integrated, wireless, self-contained transceiver comprising robotic antenna pointing and an interface system for satellite, conventional antenna, and radar applications for personal, commercial, and military use. The system of this invention provides a portable, remote-controlled or automated robotic (capable of operating in an unmanned mode) transceiver using a directional antenna pointing system. The system has the capability to locate quickly and lock onto a specified satellite antenna or other target antenna without mechanical or wire tether to a host computer or other interface.

In one embodiment of the invention, a mobile mount apparatus is provided for a self-contained wireless PC-server-based satellite communications system. The satellite communications system includes a multi-axis robotic pointing apparatus supported by a plurality of DC servomotors and position feedback sensors. The satellite communications system further includes a computer and data acquisition interconnect providing local monitoring and control of system functions and server function between user(s) and the satellite service provider. The satellite communications system further includes a multi-conductor commutating connector allowing the system to rotate 360 degrees and beyond while providing system power from a vehicle-mounted or locally available battery.

The invention comprises in one embodiment a radar and satellite communications link. In another embodiment, the system provides a wireless link via transceiver as well as a satellite link. It further comprises a system for the pointing of a directional antenna at designated cooperative or uncooperative targets.

The system is able to use GPS or GLONASS to locate itself. On board sensors such as GPS, multi-axis inclinometer, and a digital compass provide system terrestrial location and orientation in every axis. These data are critical in determining the relative location of space vehicle satellites and land based target antennas. The system is further able to determine pointing angles from its location and from the known ephemerides of target satellites. Alternatively, in a purely terrestrial environment the system can steer an on-board directional antenna or optical transceiver to any one of a plurality of distributed transceiver antennas or radiators.

In its most general embodiment, the system of the current invention is a completely self contained, PC-based transceiver capable of handling voice, vision, data, and telemetry without any wiring or personnel. Alternatively, it is an advanced communications translator/repeater in that it can receive a transmission from a wireless device such as a PC with WLAN, a palmtop, a cell phone, or other device, and translate the transmission onto an extra-terrestrial carrier targeting a satellite. In reverse, it can receive data from a satellite and translate it to land-based communications devices.

In another embodiment, the system is a portable automated universal transceiver system with a steerable articulating antenna providing both terrestrial- and extraterrestrial-based telecommunications and telemetry operations. This self-contained portable transceiver provides all the functionality of a combination of a universal repeater station, a telemetry station, and a satellite communications portal. As a freestanding locally-powered system it can provide temporary tactical communications for emergency response and military operations and temporary back up communications when stationary systems fail. This system can be placed on the ground, on a vehicle, on a rooftop, or on any other surface in short or long term service and provide full duplex communications between earth bound users and space-based satellites.

In secure law enforcement or military operations where radio silence is essential, the inbound, outbound, and both carriers can be laser beams. As a pure repeater/carrier translator, the system can convert local low power personal communicators like cell phones and handie talkies into worldwide voice-over-IP (VOIP) technology.

This locally battery-powered system can be placed in a remote wilderness area and by mounting a long range infra-red sensor into the Sensor Interface the Communications System can provide around the clock unmanned surveillance of hundreds of square miles of area. Alternatively the military could deploy this system into enemy territory and with motion or vibration sensors plugged into the Sensor Interface could monitor enemy troop movements.

An on board data acquisition sub-system provides a portal to external measurement and detection devices such as local weather, seismic, fire detection, motion detection, intrusion detection and virtually any sensor used today in measurement and security. When an area must be observed for a change in activity whether it is a fire in a desolate forest or troop advancements in a hostile environment this system provides unmanned monitoring and reporting all on local power. The communications protocol can be low to mid power local omni directional or directional transmission or dish type earth to satellite based transmission.

DESCRIPTION OF THE PREFERRED EMBODIMENTS

For the purpose of illustration, the satellite communications apparatus of the present invention is specifically described as a wireless mobile mount that is affixed to the roof of a vehicle. However, the satellite communications apparatus can be attached or freestanding and can be on any relatively flat surface, powered locally and with or without any physical mounting to an object or structure.

The system, sometimes referred to below as the Universal Transceiver system, and other times referred to below as the Mobile Satellite System (MSS), is capable of housing all the components necessary to make up a completely portable self-contained two way communications center able to interface with simple land-based operations as well as satellite based, all inside a light weight forced-air thermoelectrically cooled fiberglass NEMA enclosure. Once an application is identified, the appropriate hardware, such as RF, modems, transmitters, receivers, and other support devices can be configured inside the NEMA enclosure and made available.

The Universal Transceiver is split into two major sections, the lower assembly and the upper assembly. The lower assembly is a universal mounting platform that will remain mostly fixed in configuration providing most of the mechanical functions including Azimuth (Rotation of system on a low profile turntable) and Elevation (Pitch from stow to fully upright).

The lower assembly consists of the turntable, The Azimuth motor, the Elevation motor, the elevation gear reducer, absolute position encoder, commutating rotary connector, stow sensor, and docking control board module. The absolute position sensor provides azimuth location counts to the on board computer. The stow sensor provides an acknowledgement of when the system is stowed or in its fully collapsed position. The docking control board houses the motor drivers, imbedded processor, GPS system, data acquisition, power conversion and distribution. This module is easily undocked for quick in field service. All interconnect between lower assembly devices are accomplished inside the turntable for protection. All lower assembly I/O is routed to a connector (J15) where an interconnect cable is plugged in connecting the lower assembly to the upper assembly.

The Universal Transceiver runs entirely on 12 volts from battery, fuel cell, solar power or other 12-volt source. On board power conversion provides power to on board devices that require more than 12 volts to operate.

12-volt system power is applied to a multicontact coaxial commutating connector, which allows the system to freely rotate continuously on a turntable. The rotating upper half of the commutating connector presents the 12-volt system power to the docking board assembly #200433 via J11. The 12-volt power is then filtered to mitigate inbound transients and outbound EMI and RFI.

Figure 1:
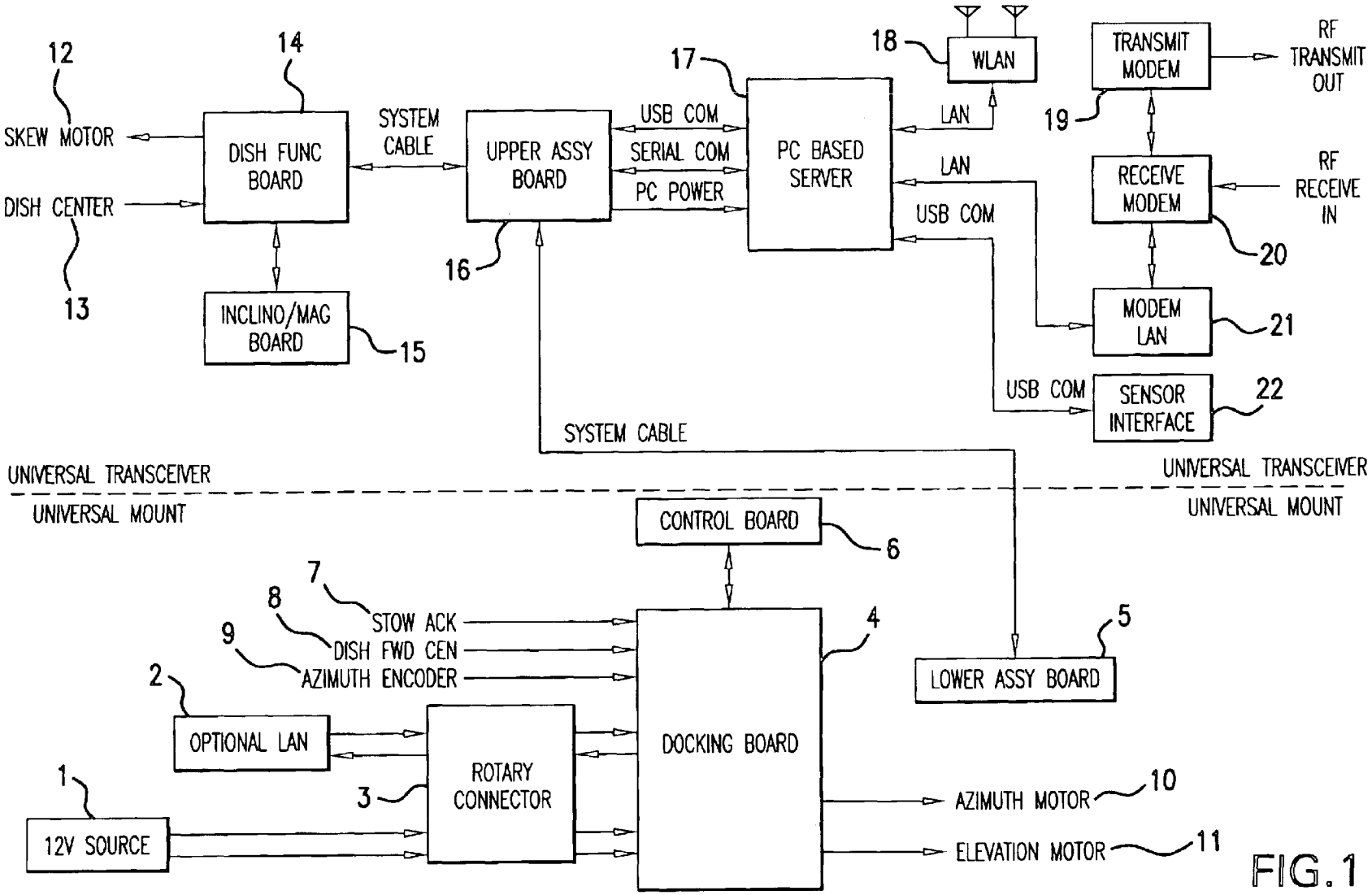
FIG. 1 is a block diagram of the overall structure of the operating elements of the portable transceiver of this invention.
Figure 2:
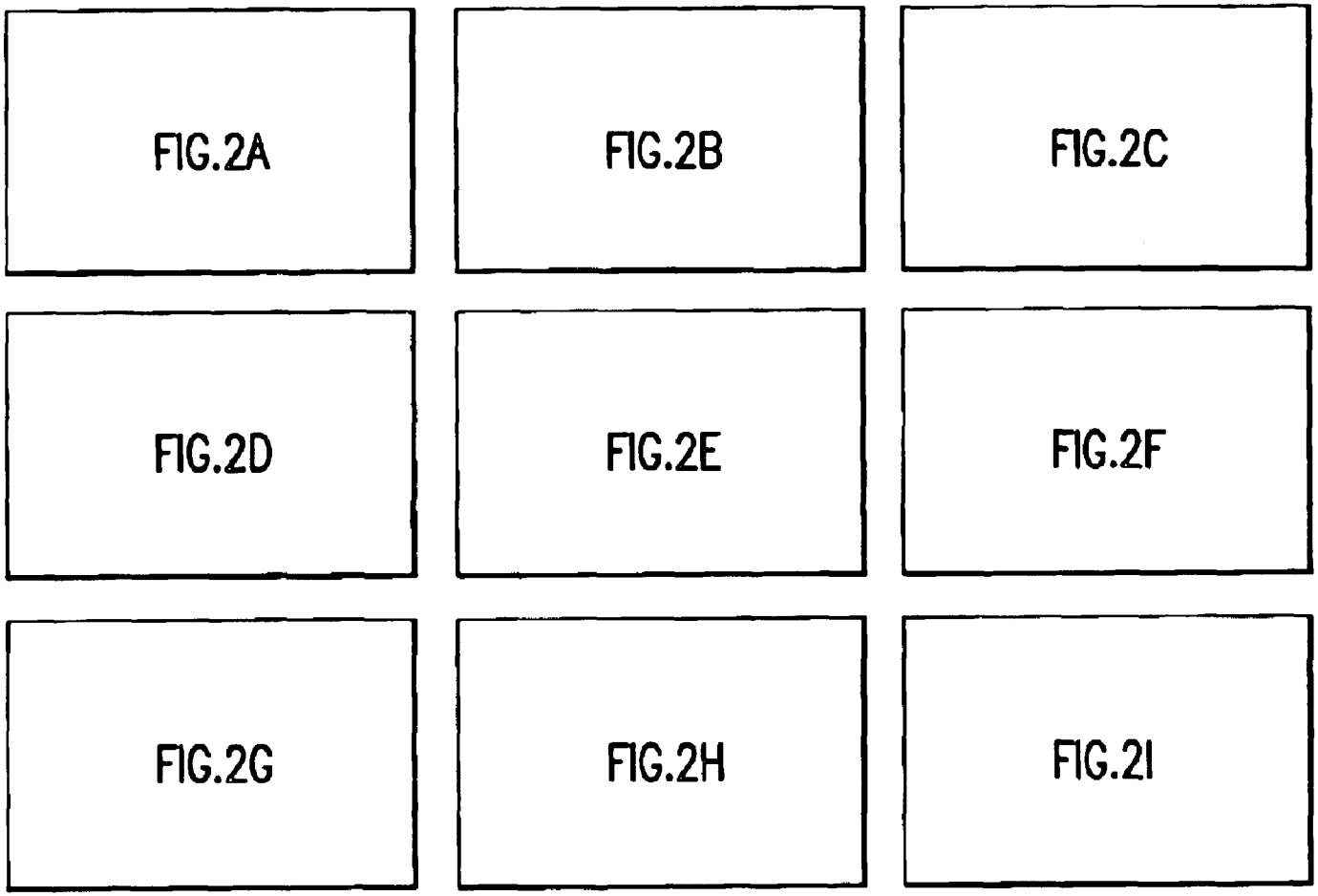
FIG. 2 is a more detailed display of the relationships and connectivity of the system shown in FIG. 1.
Figure 2A:
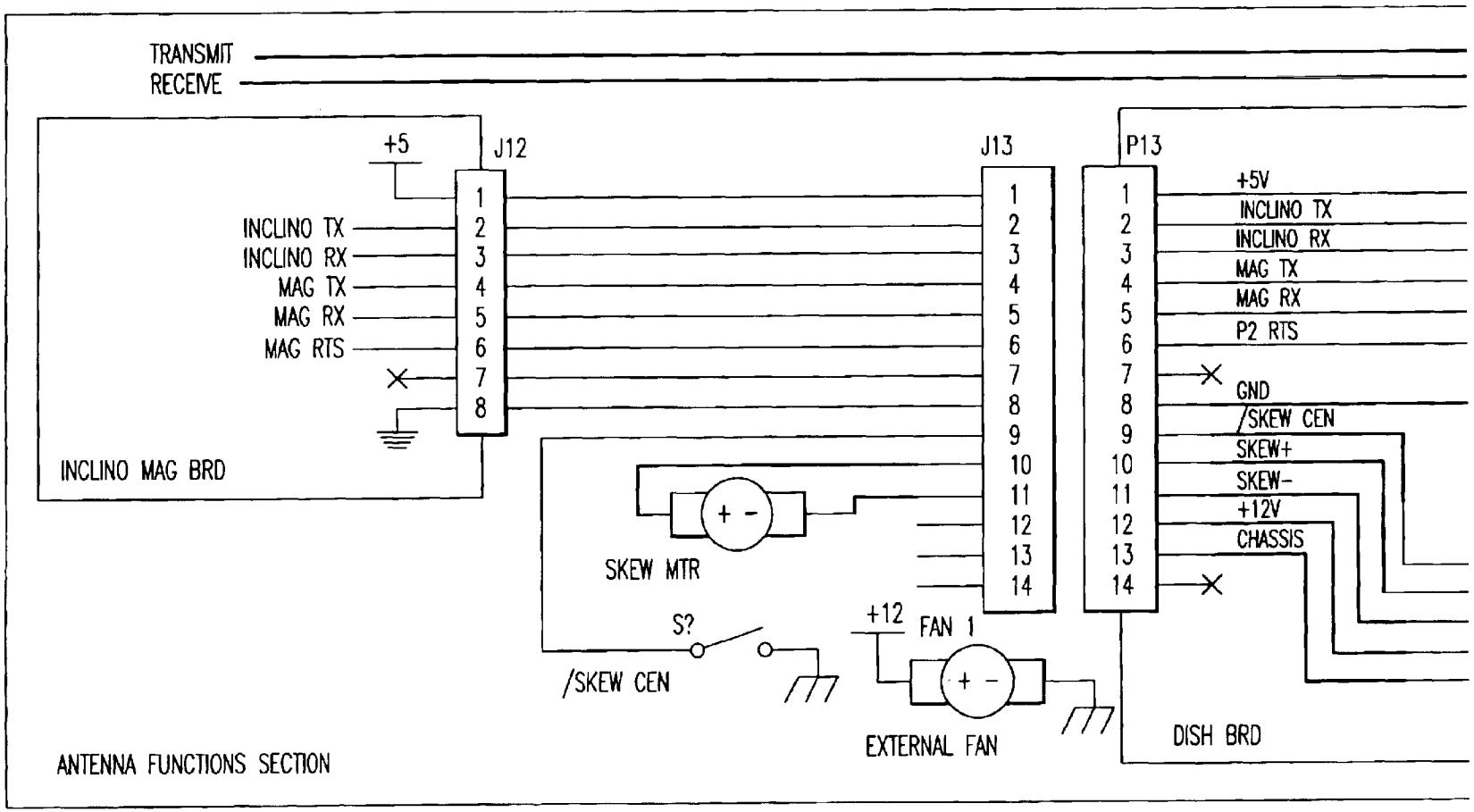
Figure 2B:
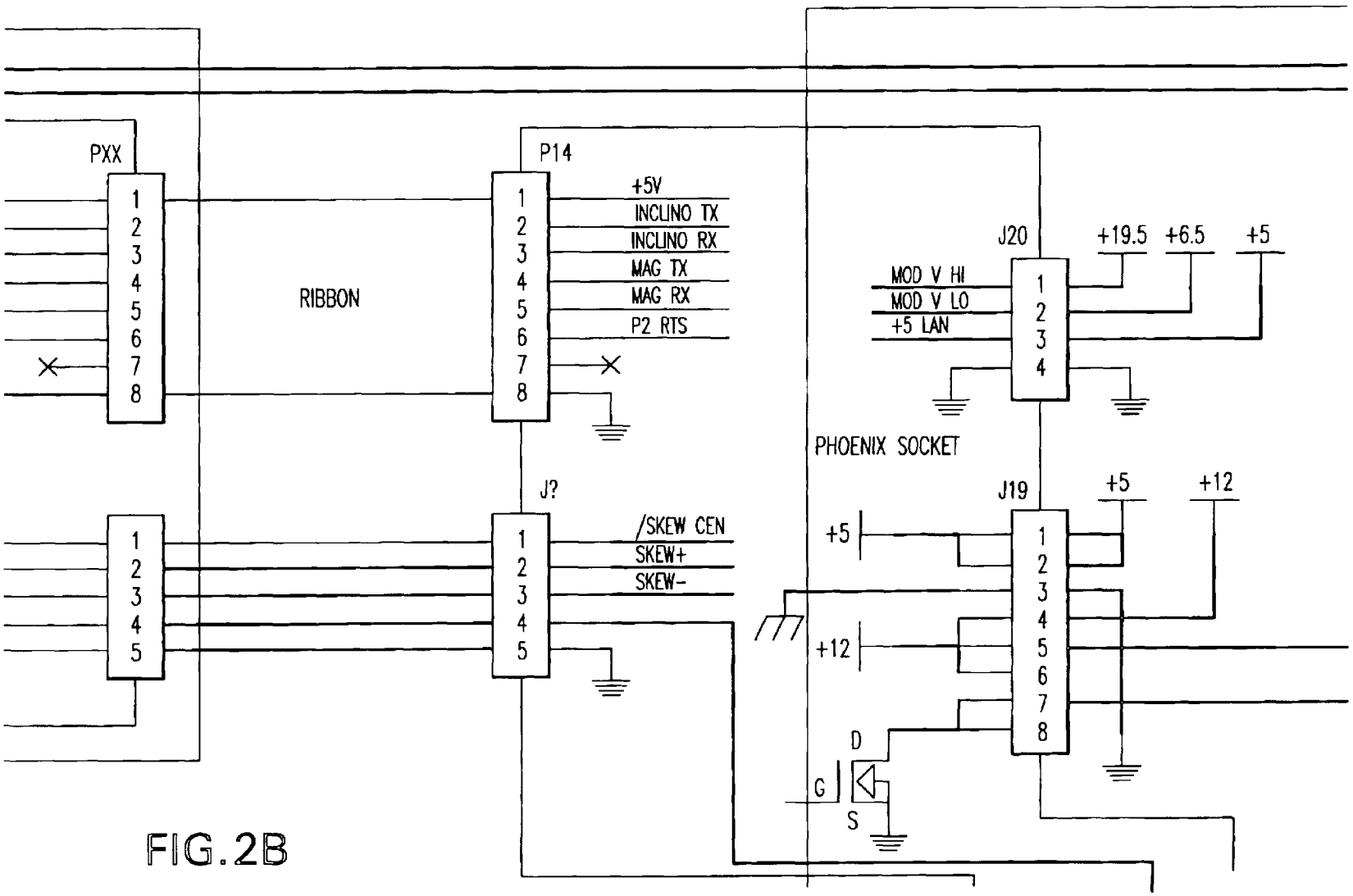
Figure 2C:
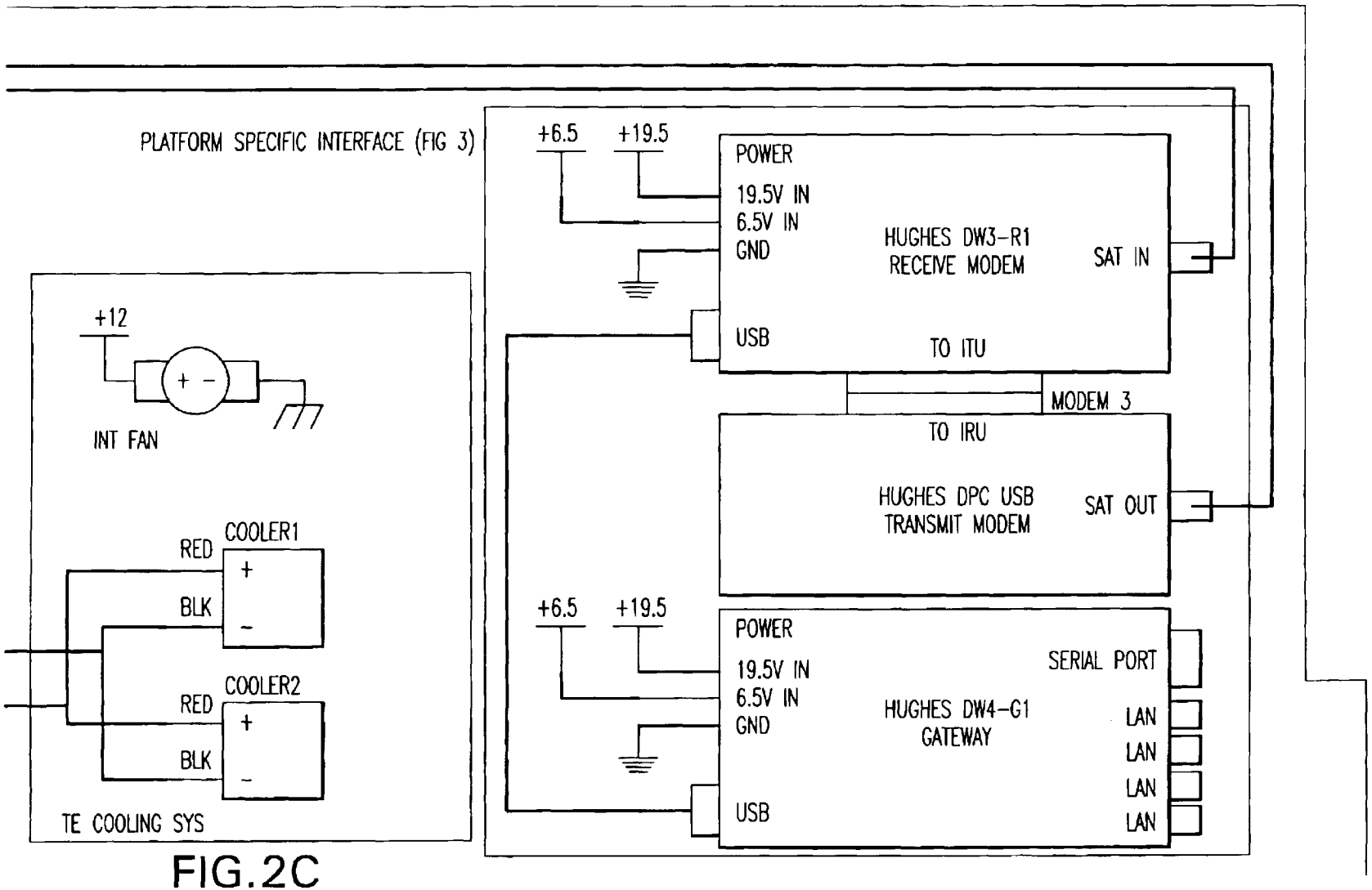
Figure 2D:
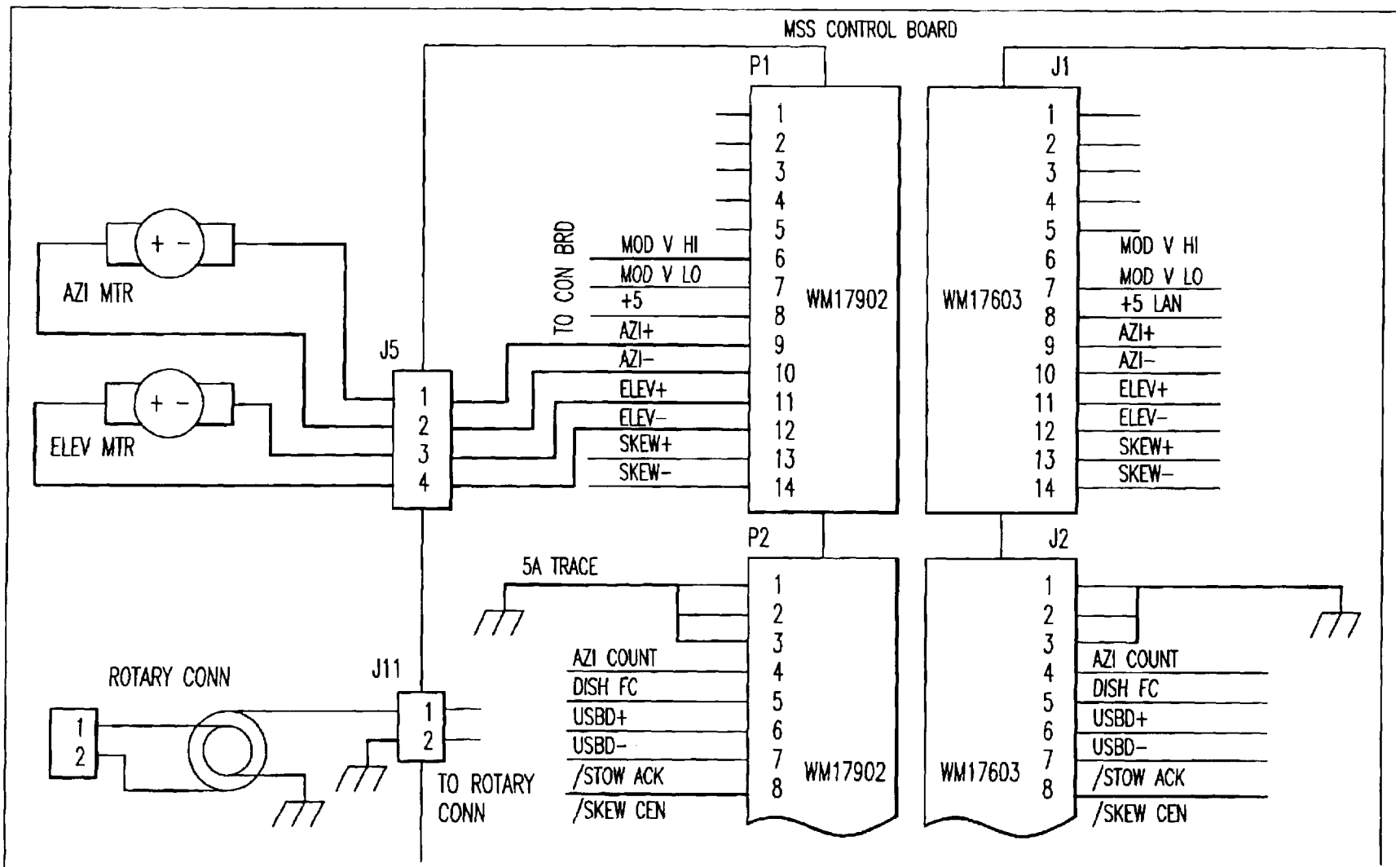
Figure 2E:
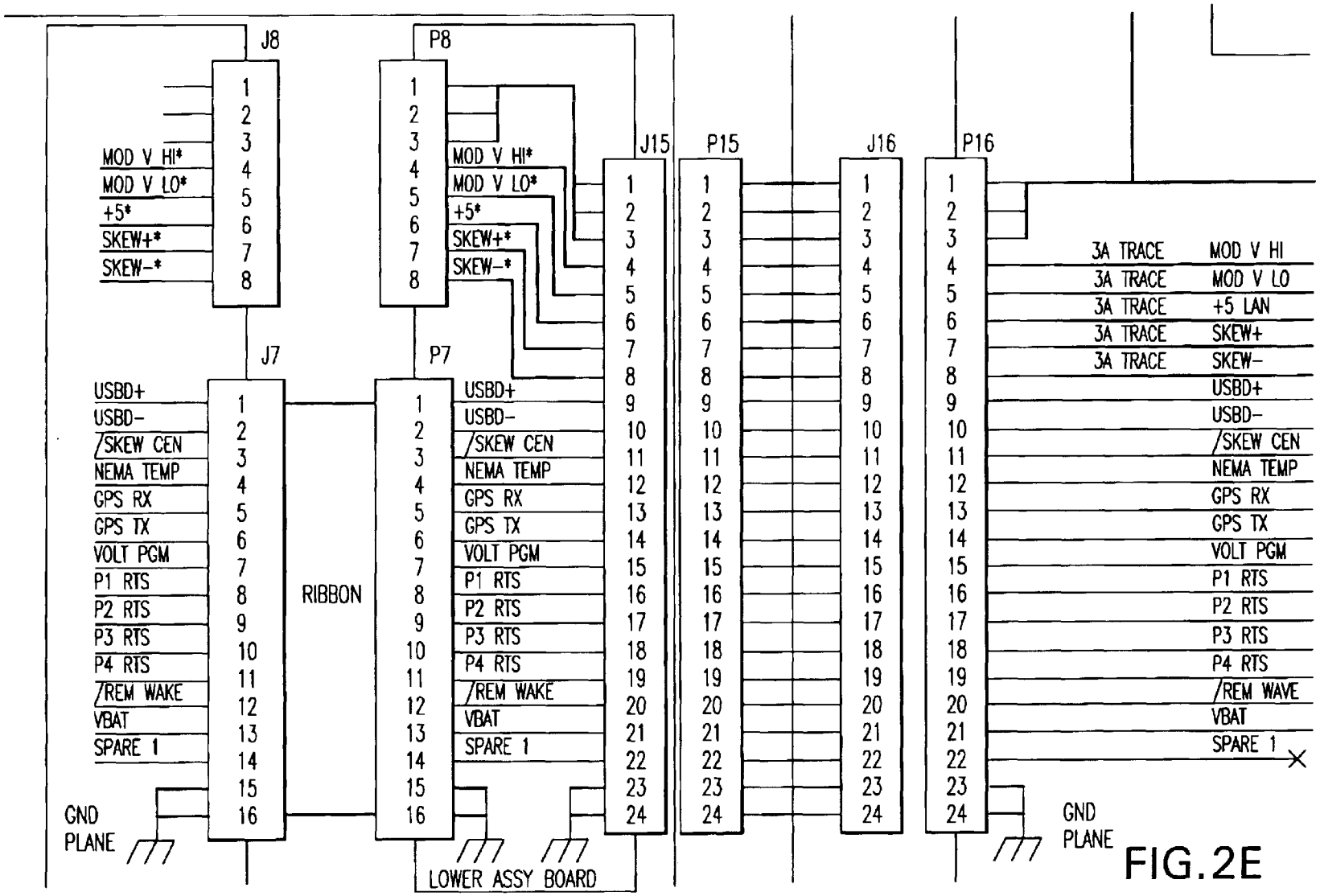
Figure 2F:
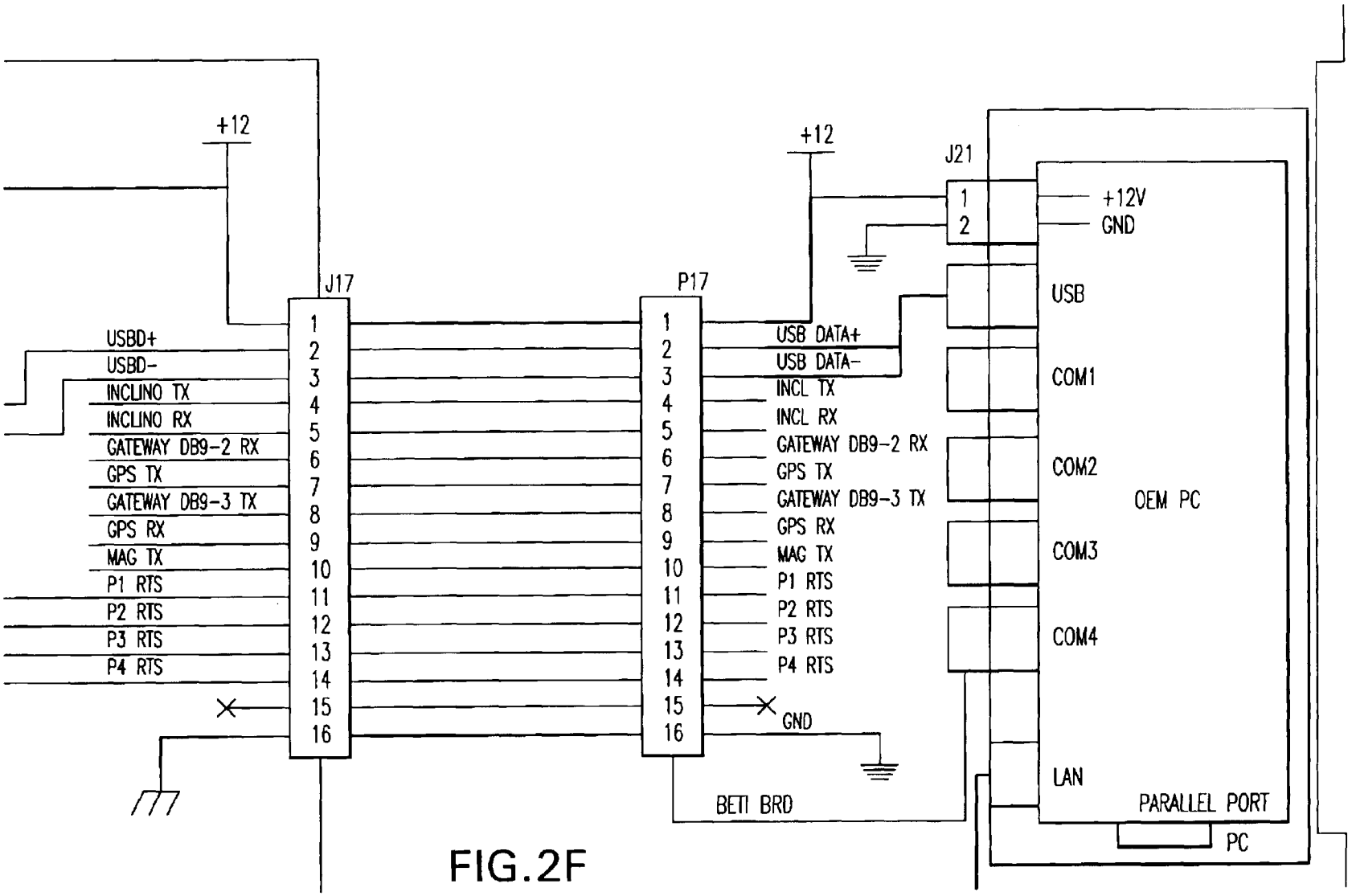
Figure 2G:
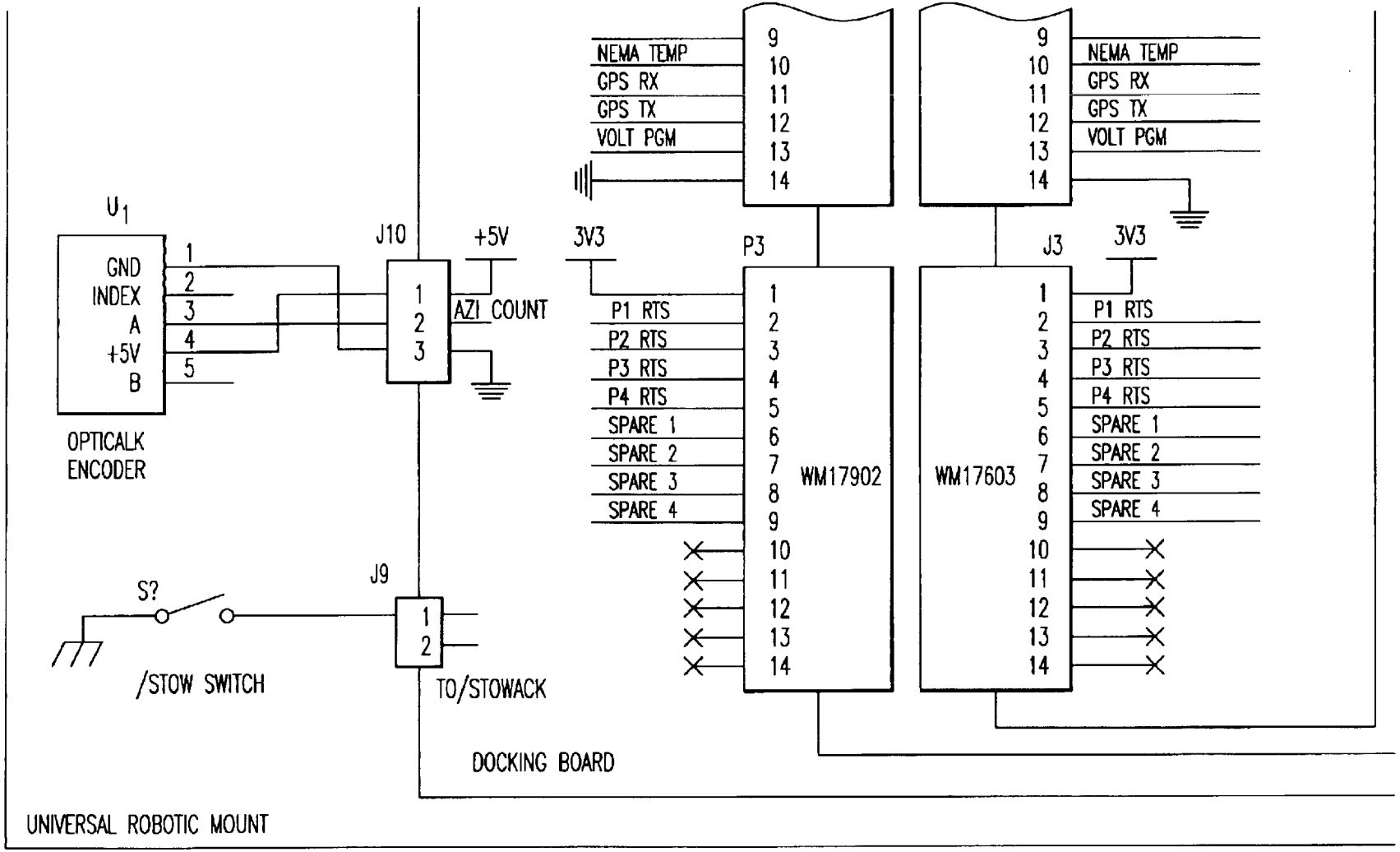
Figure 2H:
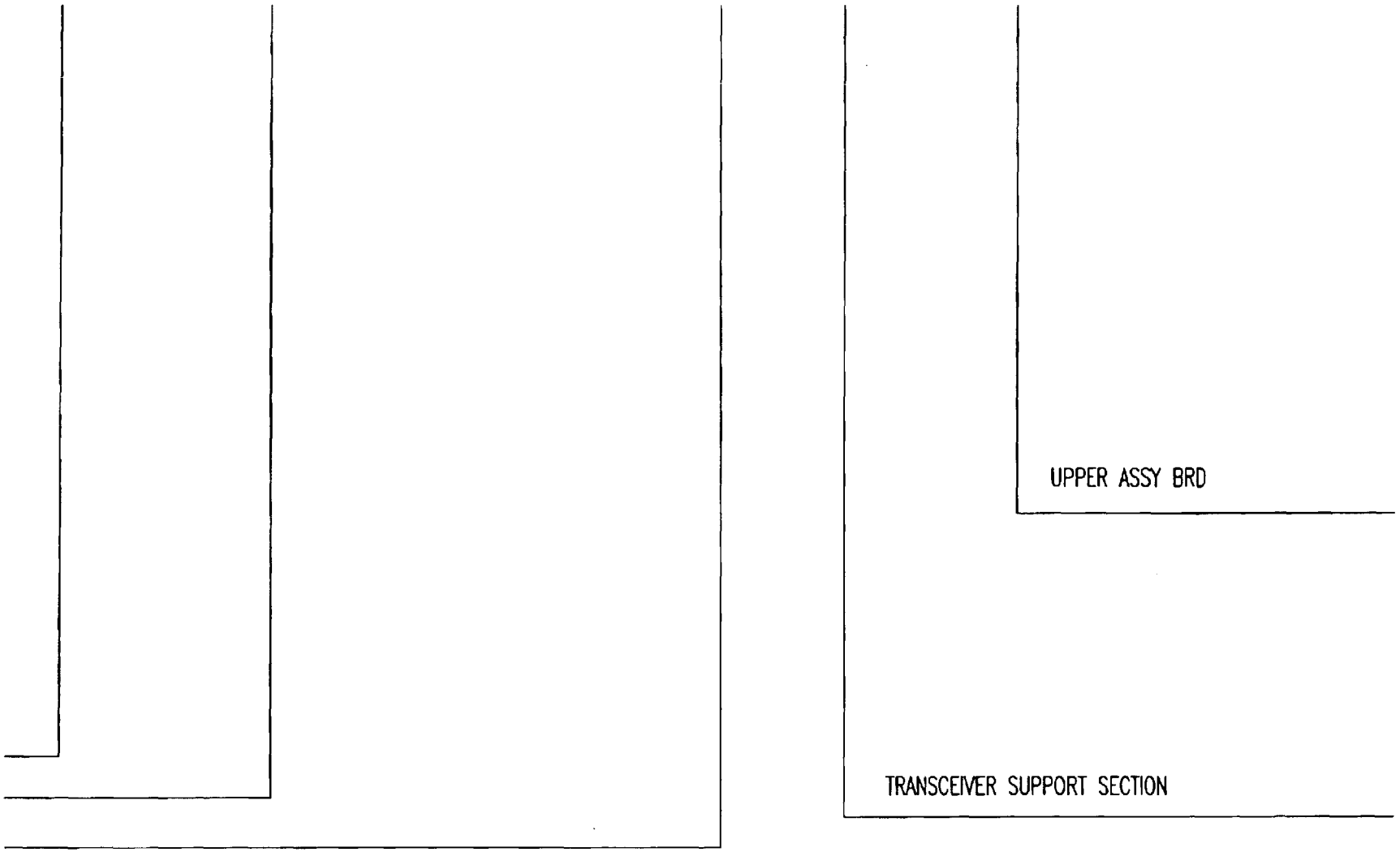
Figure 21:
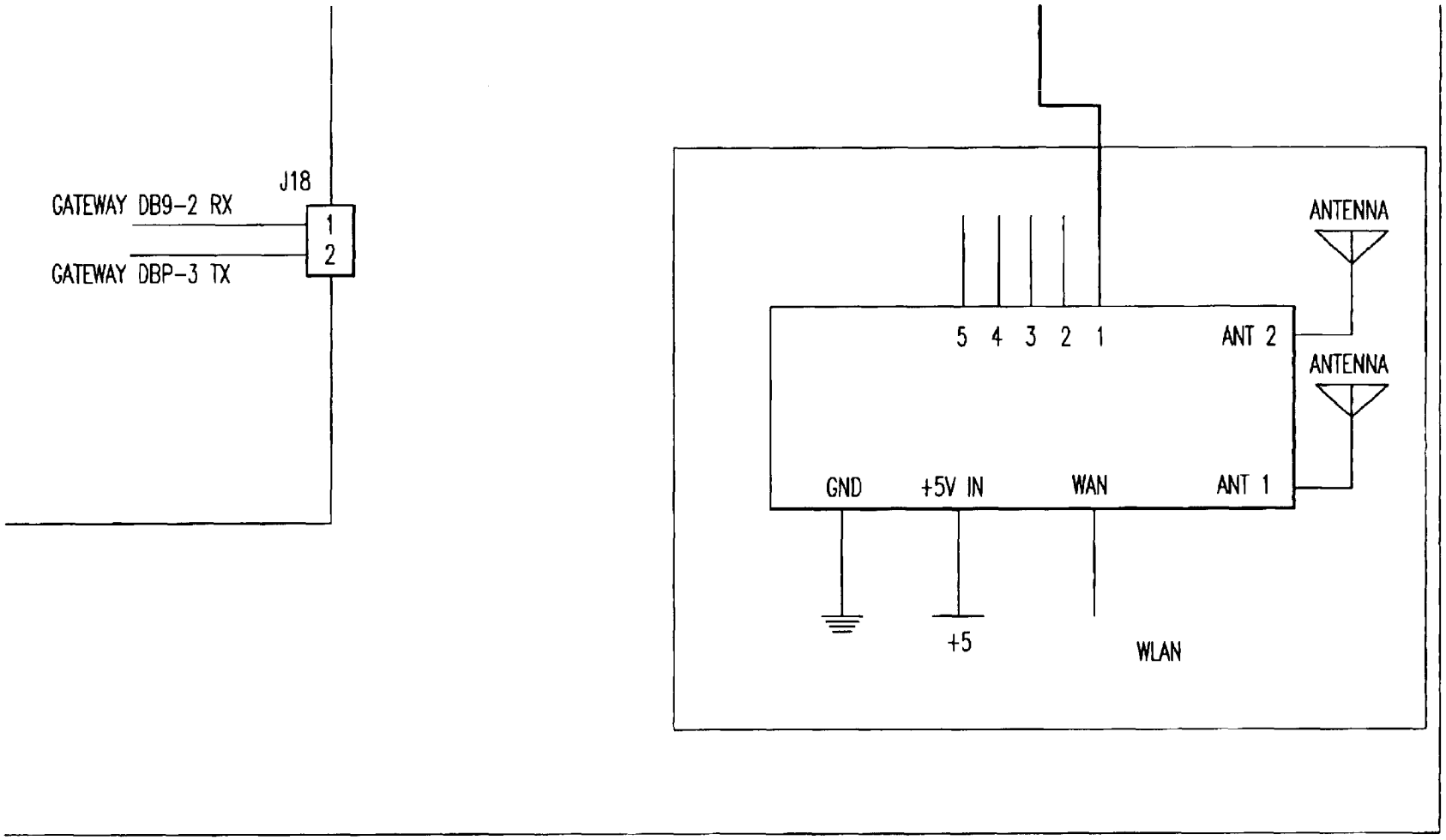

FIG. 1 is a block diagram of the wireless PC-based satellite communications system. FIG. 2 portrays in more detail the relationships and interconnections of parts of the system. The communications system includes a rotary commutating connector 3 which is mounted inside the system's turntable housing and provides interconnect between a 12 volt power source 1 and the system docking board 4. The rotary commutating connector 3 allows continuous rotation of the system without disruption of power or signal when the optional LAN 2 is utilized. The LAN provides a hard wire back up to the wireless LAN (WLAN) 18 and may be used in lieu of the WLAN 18 in high security applications.

The Docking Board 4 provides interconnect functions between the Control Board 6 and turntable mounted devices including the rotary commutating connector 3, Stow Ack 7, Dish Fwd Cen 8, Azimuth Encoder 9, Azimuth motor 10, and the Elevation Motor 11. The Control Board 6 docks onto three blind mating connectors on the Docking Board 4 providing easy removal and replacement in case of Control Board 6 failure. The Control Board 6 is housed inside a sealed aluminum enclosure and contains an imbedded microprocessor to handle data acquisition, pulse counting, and control functions. The Control Board 6 further contains the GPS system used to determine earth coordinates of the system. The Docking Board 4 further provides interconnect between itself, the Control Board 6, and turntable mounted devices including the rotary commutating connector 3, Stow Ack 7, Dish Fwd Cen 8, Azimuth Encoder 9, Azimuth motor 10, and the Elevation Motor 11, and the Lower Assembly Board which provides further interconnect up to the Upper Assembly Board 16 by means of a cable.

The 12-volt system power is then routed to a high side P-Channel MOSFET that acts as a solid-state relay enabled by a command from the remote control receiver (REC 1) located on the Upper Assembly Board #200432. The remote control receiver is directly connected to 12-volt system power and awaits a digitally encoded carrier that is sent from a hand held or stationary wireless transmitter up to 300 feet away in consumer and commercial applications. In some industrial, hazardous, and military applications a long-range remote control may be a satellite phone or other ultra long-range transmitter. Once the proper encoded remote control command is received it produces a wake up command that enables the aforementioned high side switch MOSFET which then allows 12-volt system voltage to be applied to all system destinations.

The upper Assembly board and all upper assembly devices excluding dish function devices are housed in the weatherized and cooled NEMA-type enclosure. The upper assembly comprises the NEMA enclosure and antenna element(s) as well as other system support functions like the inclinometer, Magnetometer, Skew motor, temperature control, necessary communications protocol support devices like RF modems, etc. The upper Assembly board contains an RF remote control receiver that remains powered-on while the system is powered off awaiting a wake up command from a corresponding hand-held transmitter or FOB. The Transmitter and receiver are address code matched to prevent accidental activations by nearby alike transmitters. Upon power up resulting from a wake command a P-Channel MOSFET configured as a high side switch passes 12-volt power to the entire system causing the PC based server to initialize. The upper Assembly board 16 provides interconnect between the lower assembly devices and circuits and the upper assembly devices and circuits.

The Upper Assembly Board 16 more particularly provides interconnect to the PC based Server 17 and dish or other antenna functions. The Dish Function Board provides interconnect to and from the Inclino/Mag Board 15, which provides dish inclination and true north heading data to the PC, based server 17. The Dish Function Board further provides interconnect to the Skew motor 12 and the Dish Center sensor 13. The Skew motor 12 steers the dish vertically clockwise or counter-clockwise up to 45 degrees allowing the dish to match the cross polarization of its intended target satellite. The Dish Center sensor alerts the PC based server that the dish is at full center, which is important when stowing the system and dish.

The PC based server 17 is the heart of the system and provides local monitoring and control of the system while providing conventional server functions between user(s) and the satellite services. The Transmit Modem 19, Receive Modem 20, and the Modem LAN 21 are platform specific devices that provide the proper interface to their respective antenna or dish. These platform specific devices are unique to each service provider's system/protocol requirements. Multi platform capability not only addresses satellite service providers but land-based systems as well. Directional Yagi, arrayed, and other conventional antenna-based platforms can be deployed using this system. The USB based Sensor Interface 22 provides I/O for application specific monitoring of sensors or other telemetry devices.

Upon receipt of the system wake-up command the on board computer initializes and once fully booted reads all relevant on board sensors, logs readings, and awaits further instructions from a local or remote user. In a satellite-based two way communications application the wake command will instantly initiate communications with a target satellite whose location is known and read from a data base and when compared to the system's terrestrial location coordinates the dish antenna will be steered to its target via a plurality of motors providing X, Y and skew axis orientation.

The core component of the server's functionality is the Operating System (OS). The OS of MSS is developed from Microsoft Windows XP Embedded. The XP Embedded tool kit allows for the creation of an OS for the specific application of hardware. The MSS OS is specifically designed for the platform of this invention and is designed around the MSS architecture.

Figure 3:
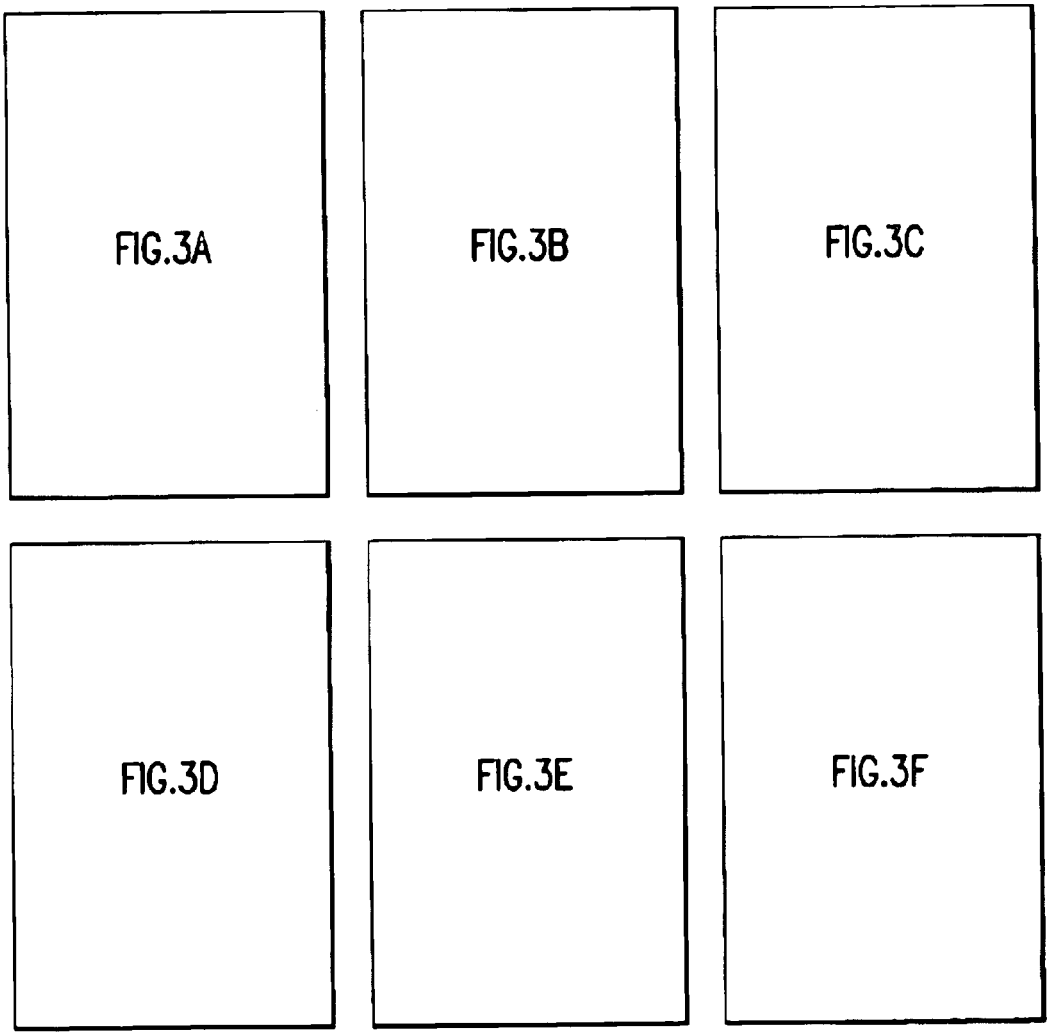
FIG. 3 is a flow diagram of the Operating System of the computer control system.
Figure 3A:
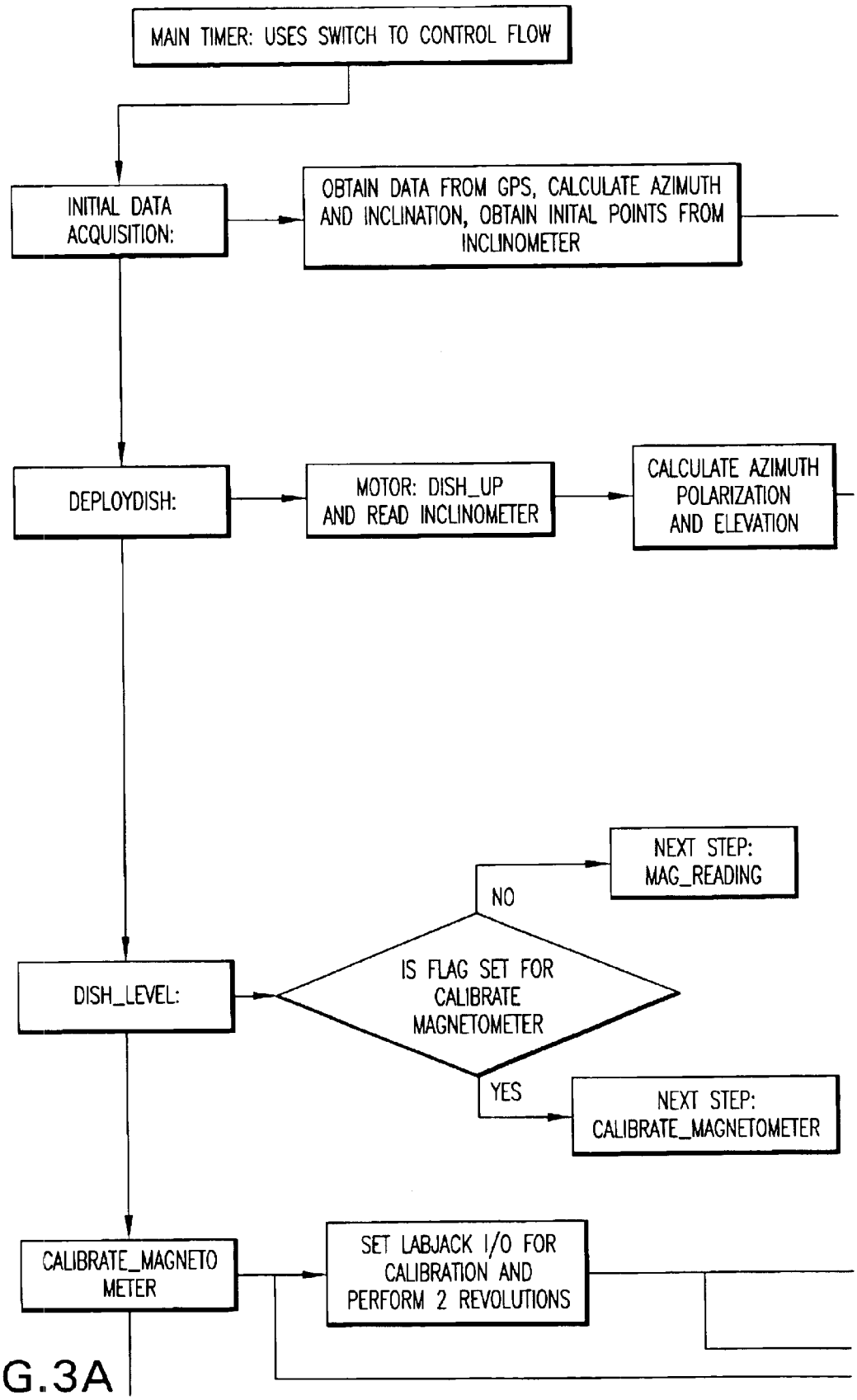
Figure 3B:
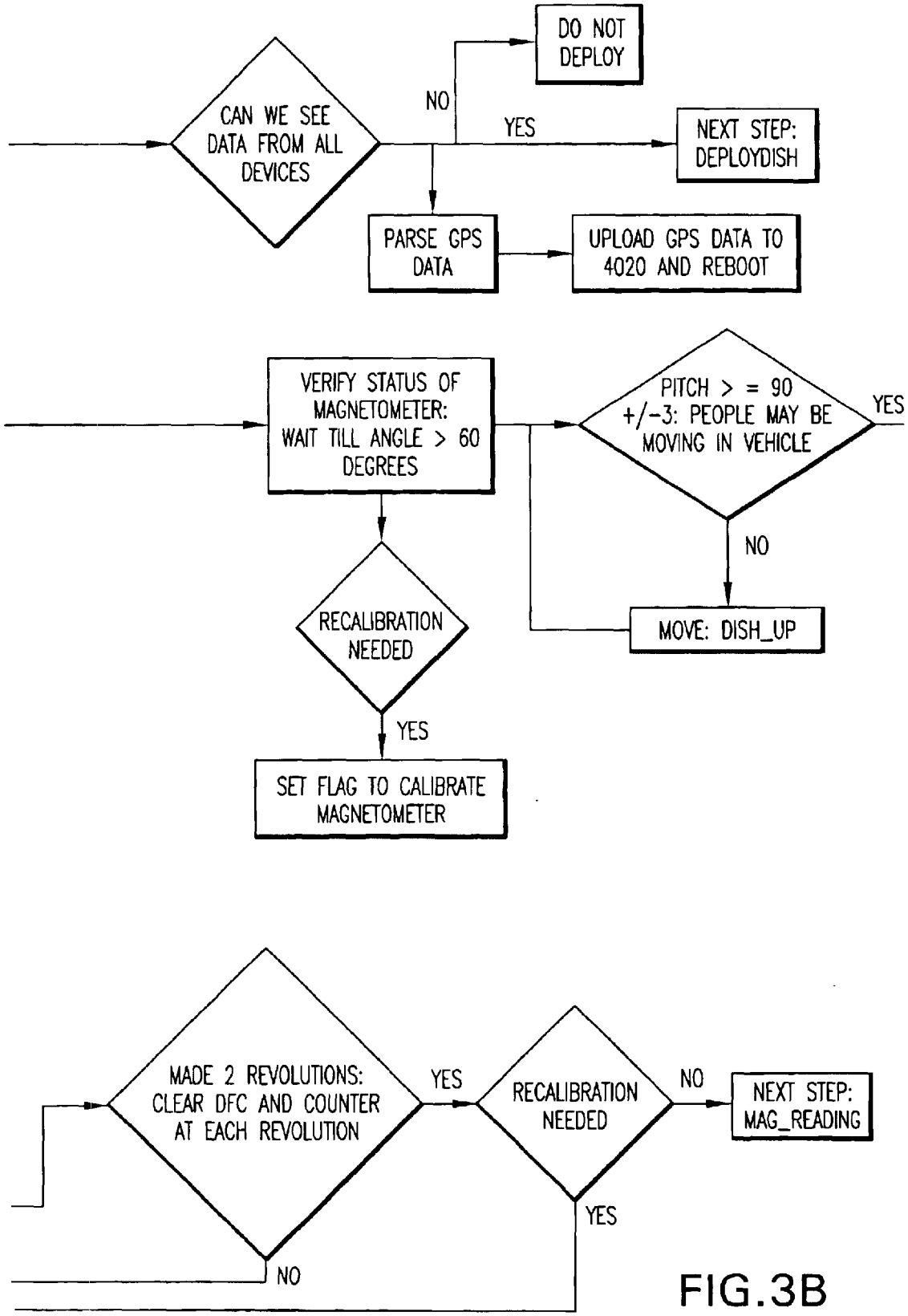
Figure 3C:
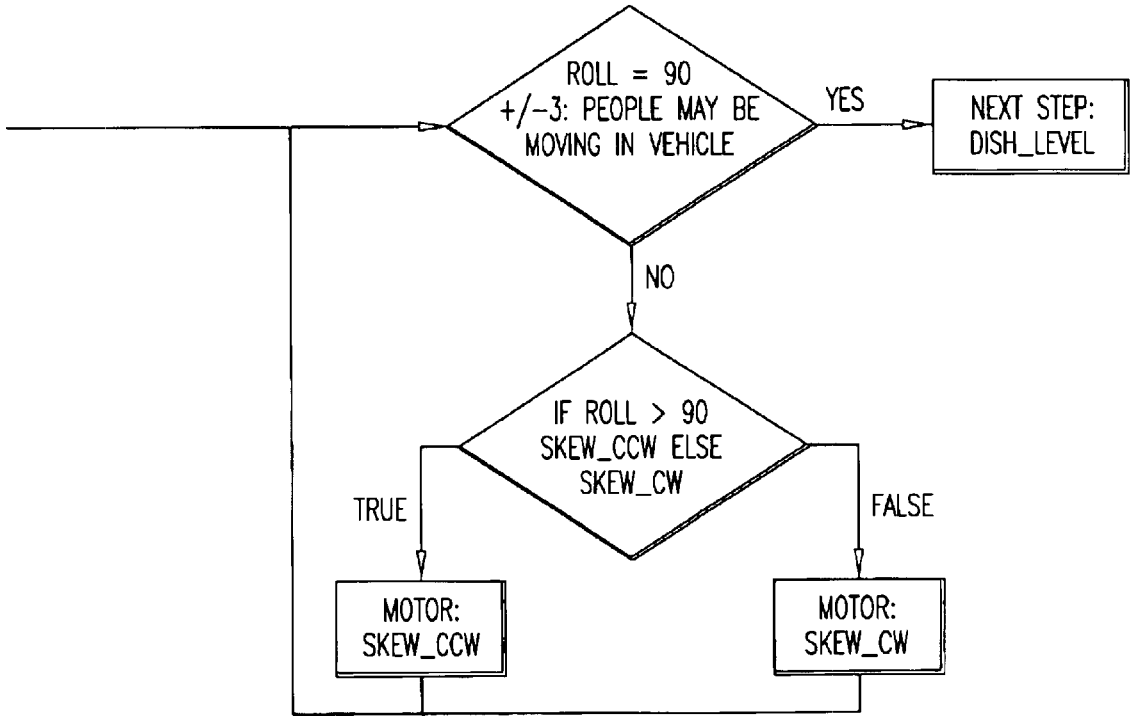
Figure 3D:
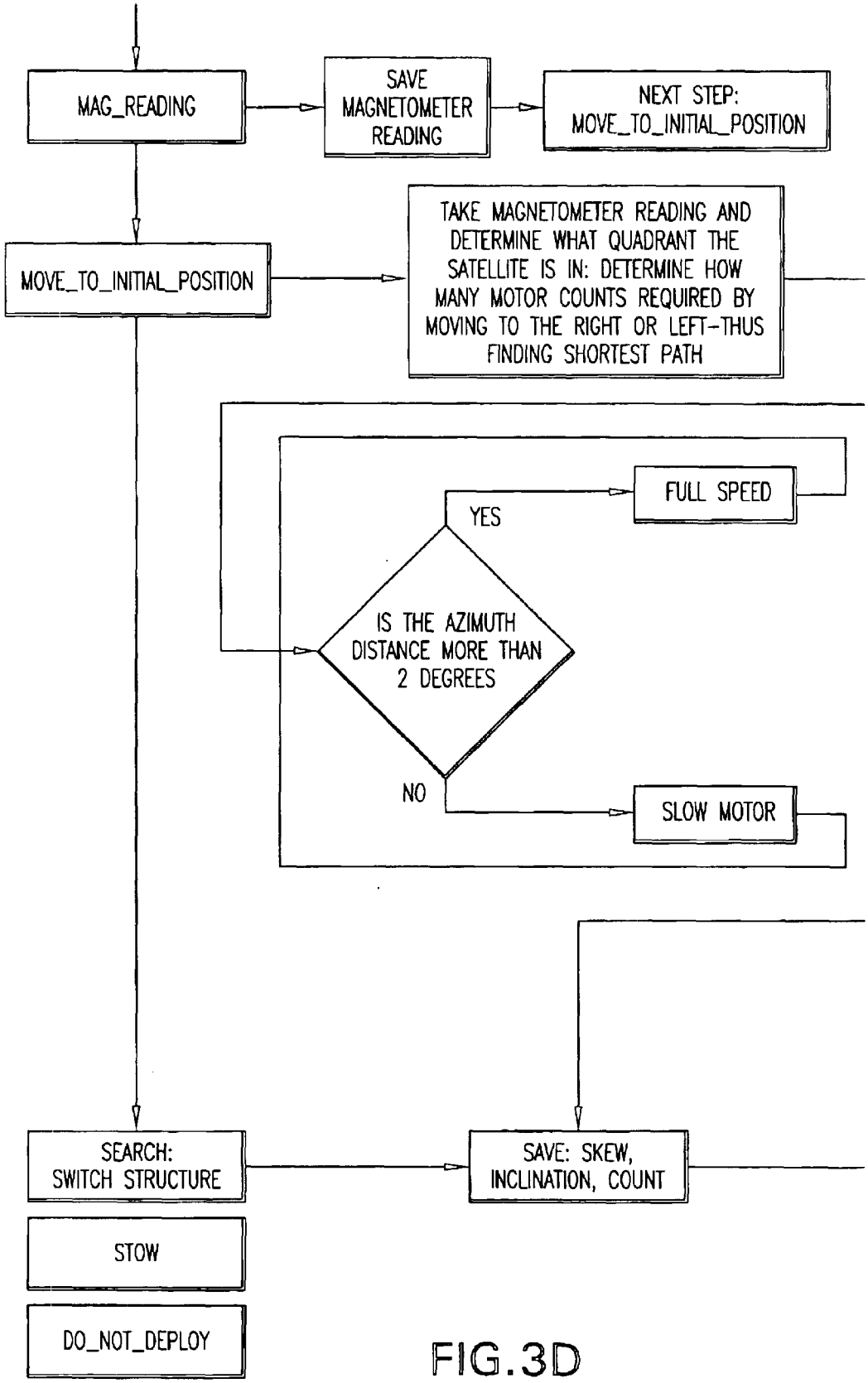
Figure 3F:
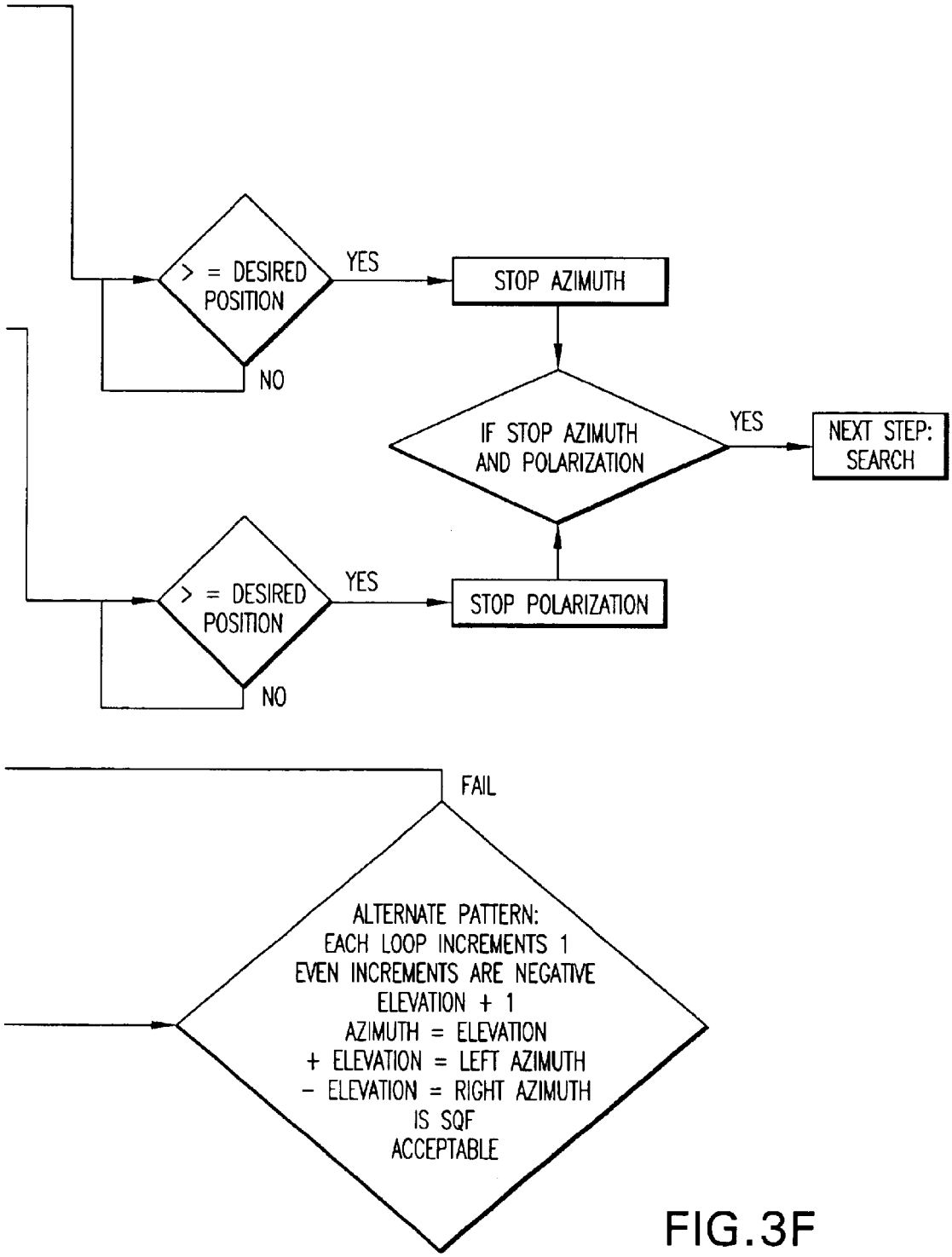

The software architecture the MSS employs, shown in FIG. 3, is called a 'Distributed Application,' consisting of an application and a service. The end-user interacts with the application and this application in turn interacts with the service. This method of program interaction is called 'Encapsulation' and is designed to protect the service from the end-user performing unwise or illegal operations; this is basically a safeguard. The application operations include such actions as stowing the dish, updates on any possible errors and required system checks, or reconfigure what satellite the system needs to point to.

Additionally, the application has a TCP/IP listener so a remote user may interact with the system. The IPC (inner communication process) from the application to the service employs message queuing. Often events happen in a very short period of time (20 ms) and with multiple applications performing their own task it miss not uncommon for an application to be unavailable for an instant. This discontinuity of communication at every instant can lead to miscommunication through lack of communication. The OS is configured to pick up after such a discontinuity.

The service acts as a logic engine to drive the hardware in such a manner to acquire a satellite signal and upon receiving the stow command from the end-user (from a remote control or interfacing with the application) will safely stow the system and power down. In order to expedite the satellite data acquisition the service is required to be in constant communication with the following devices: modem (Hughes Network System, DiRECWAY™ 4020), magnetometer, inclinometer, GPS, and controller.

The service interfaces with the modem through a serial communication port and interaction with this device will include rebooting the modem, uploading GPS data, recording signal quality factor (SQF) for both receiving and transmitting a signal. Additionally, the service will instruct the modem to perform automatic cross pole (ACP) which is required in order to pass data. Another serial communication device is the magnetometer. The magnetometer is mounted on the dish and is a highly accurate digital compass that also interfaces with the controller. The magnetometer will output data to the service; this data will include the current compass reading in addition to whether the unit needs to be calibrated or not. Calibration is required if the unit has been exposed to a large or disruptive electromagnetic filed. Input to the magnetometer is from the service via the controller. The service will determine the status of the magnetometer and give the controller instructions on what actions need to happen. For example, if the magnetometer needs to be calibrated, the service will deploy the dish until it is parallel with the ground and then instruct the controller to make two revolutions about the azimuth axis and the controller must apply pattern of high and low signals to the magnetometer during the rotations after which the service verifies the status of the magnetometer.

The inclinometer is another serial communication device. The inclinometer is mounted on the dish and informs the service of the current elevation and polarization. The GPS is the final serial communication device and is responsible for updating the service with the current longitude, latitude and determines whether the vehicle is moving or not.

The final device that the service directly communicates with is the controller via a USB interface. The controller takes commands from the service as well as makes data available to the service; the controller is also responsible for directly communicating with the magnetometer and all hardware aspects related to movement. The service either updates or polls the controller for its status more than 10 times a second. When the service instructs the controller to move an axis or motor, the service also specifies a voltage that is to be applied to the motor. The result of this fine level of granularity is the ability to infinitely control the speed at which the motors will operate. The reason for the fine level of granularity is to have the capacity to ramp up the motor speed and operate at a speed that is appropriate for the particular task at hand. For example, if the service has just moved from the deploy state to the find initial target state, the dish is at rest and so the service will instruct the controller to ramp up the motor to full speed. Likewise, when the dish is approaching the target position the service will instruct the controller to reduce the motor speed. Additionally, while the service is employing its search pattern the motor operating speed will be reduced, thereby lowering the chance of overshooting the target. Another benefit of controlling motor speed is increased reliability. If one applies an "all or nothing" to the motors, then the additional stress and jerking of the system will significantly lower the overall longevity, reliability and accuracy.

Based on data from the above devices, the service makes decisions on what actions to take in order to achieve its objective. If the objective is to deploy, the service must verify that the vehicle is not moving; if movement is detected, then the dish will not deploy. Likewise, if there is no communication response from one of the devices the dish will not deploy.

Additionally, automated satellite systems have difficulty acquiring a satellite signal if they are not on a flat or near flat surface. This is a result, among other things, of the magnetometer being affected by gimbal. Gimbal is the influence of one axis upon another and this influence will yield incorrect readings from those devices.

The MSS in general is not affected by gimbal because of the location of the magnetometer and inclinometer (both mounted on dish). When the service instructs the controller to deploy the dish it then monitors the inclinometer and when the dish has reached a position that is 90 degrees from the stow position the service will briefly stop the dish from deploying and perform the required motor actions to level the dish. This auto-correction nullifies any potential affects from gimbaling.

Figure 4:
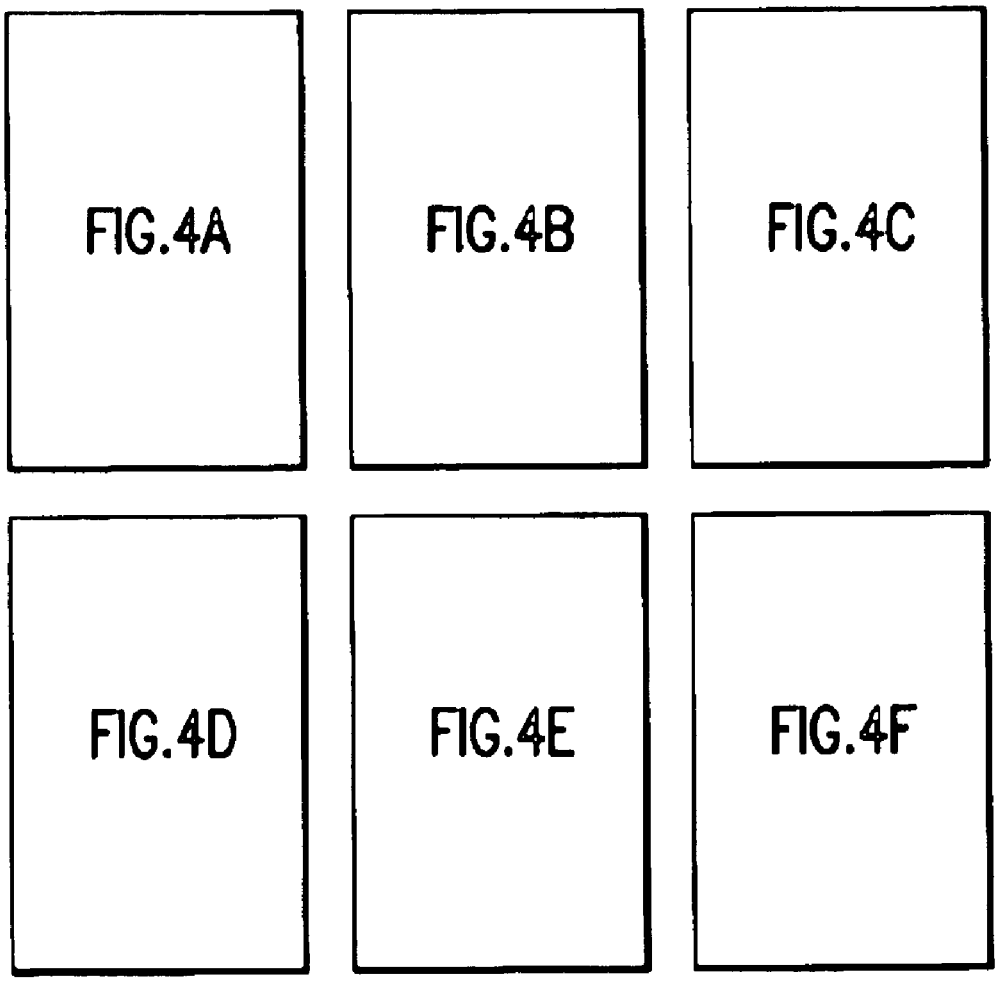
FIG. 4 shows a flow diagram of the software that controls search for a particular satellite antenna.
Figure 4A:
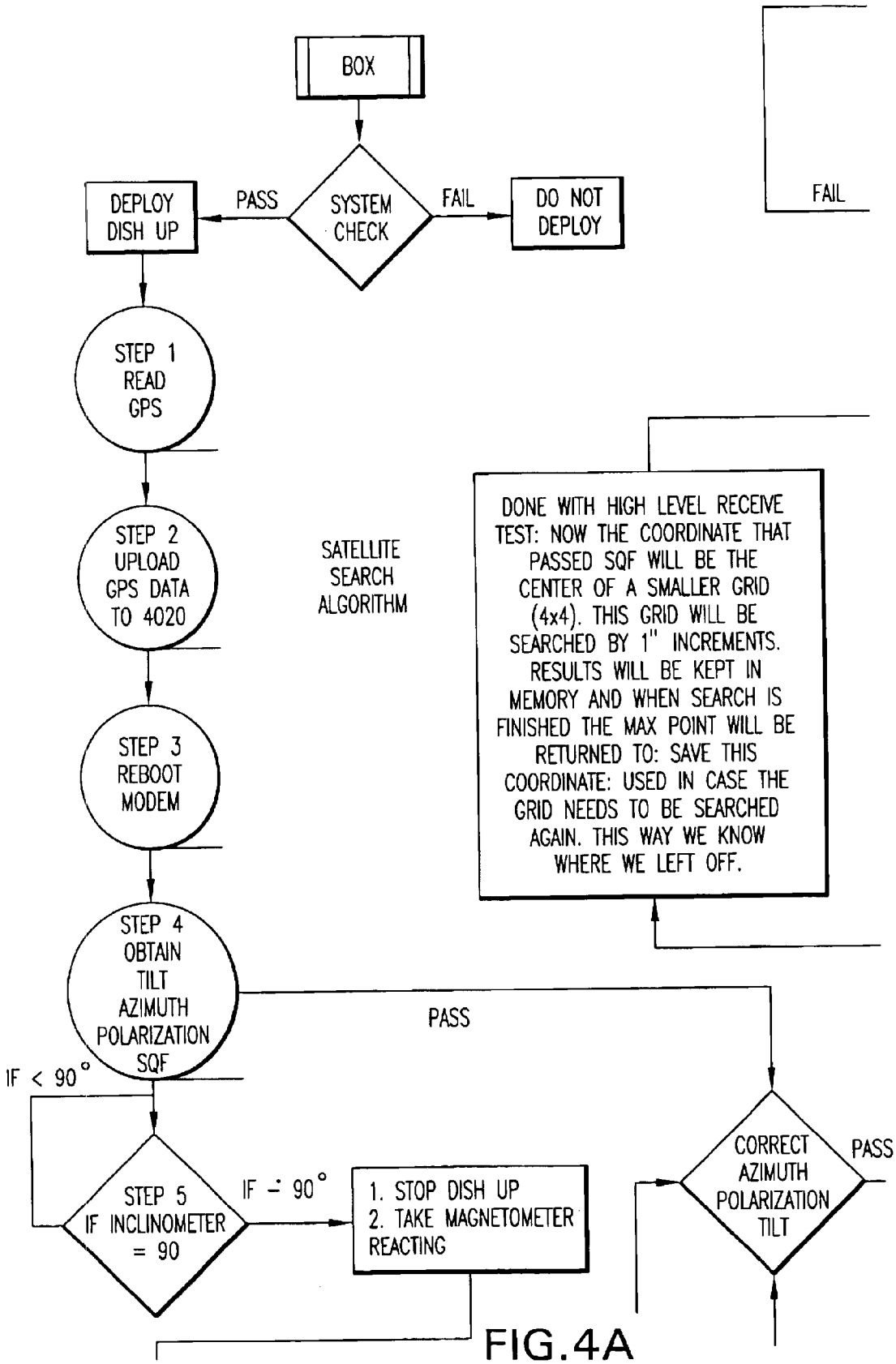
Figure 4B:
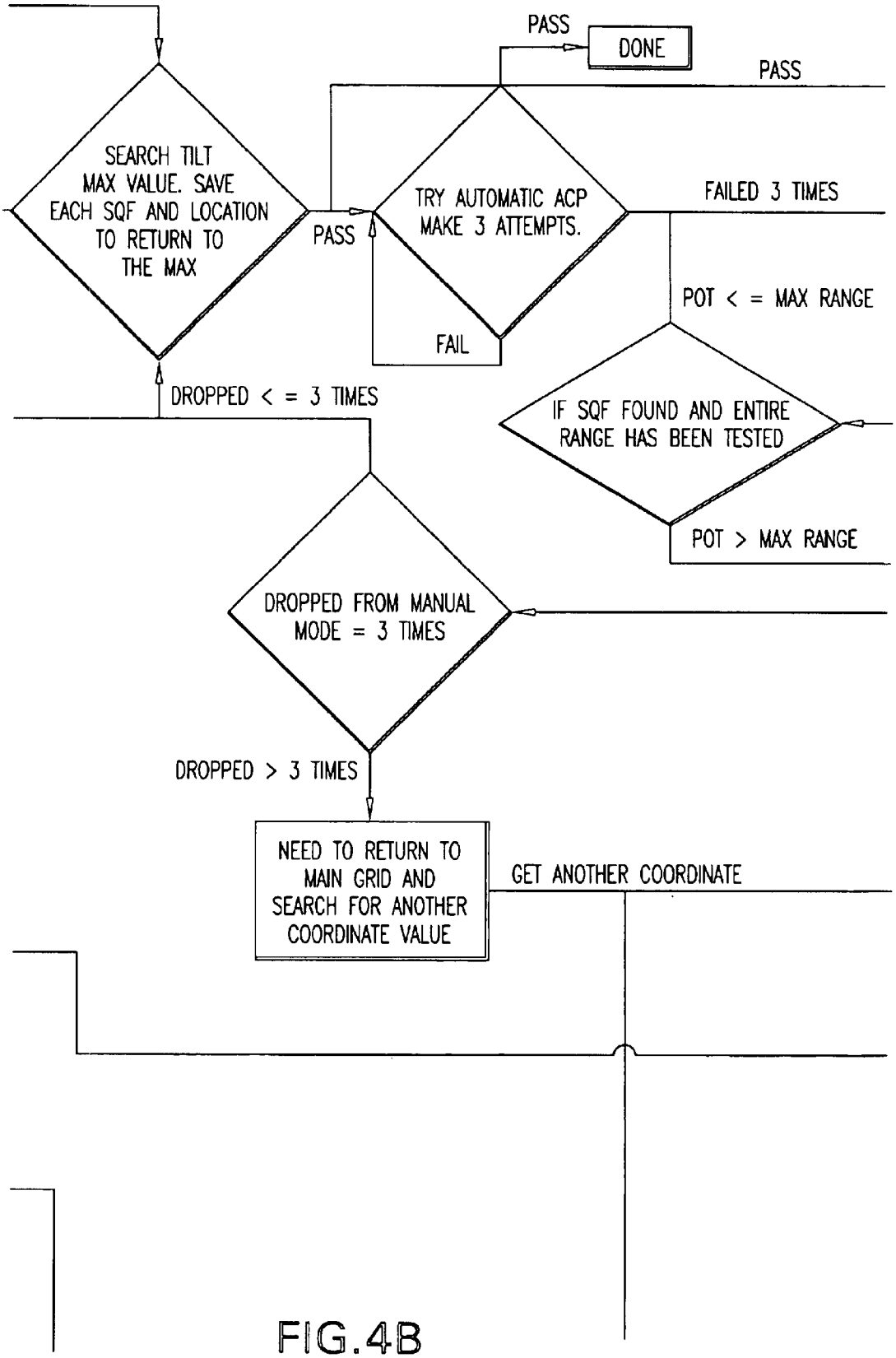
Figure 4C:
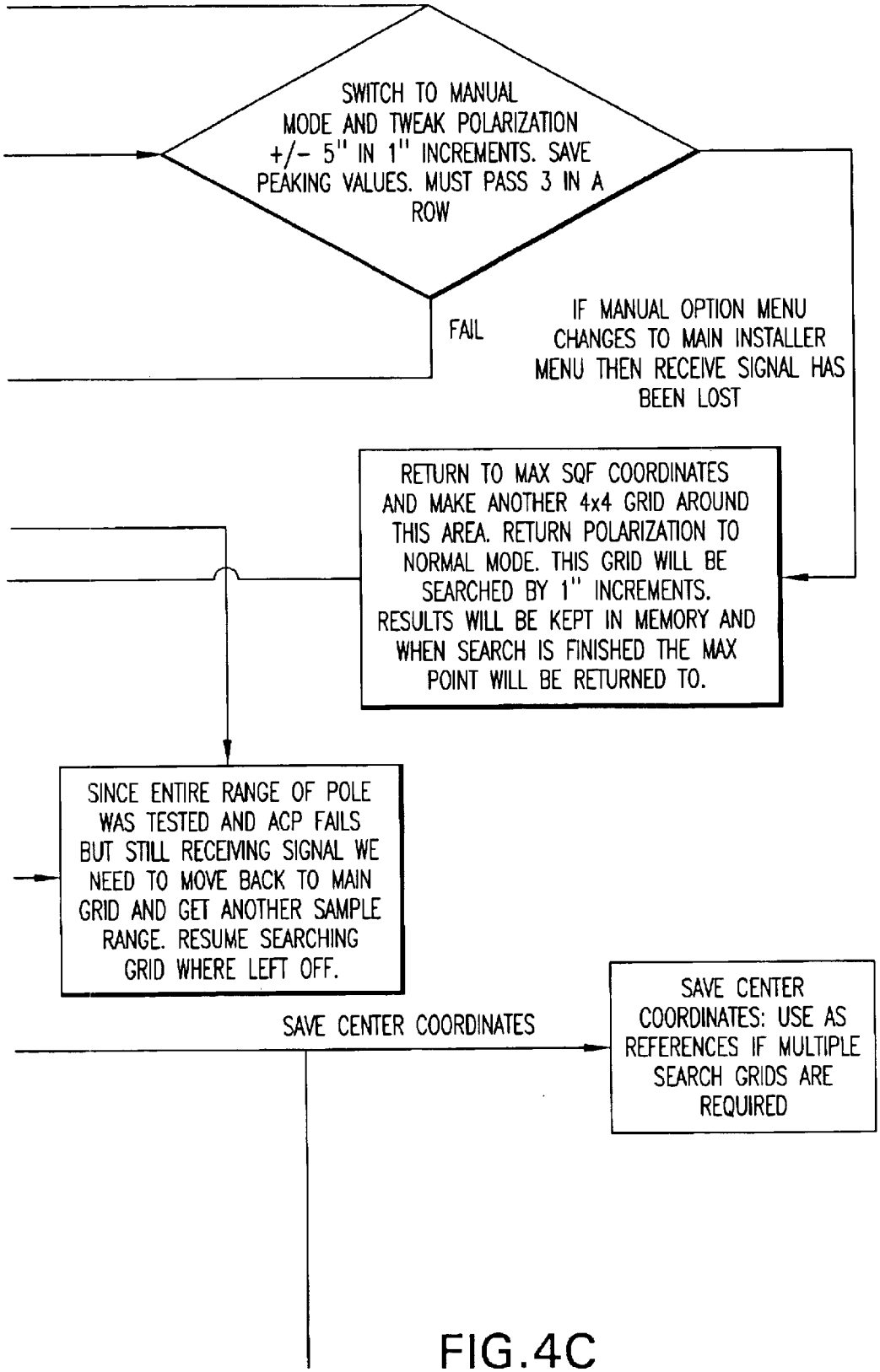
Figure 4D:
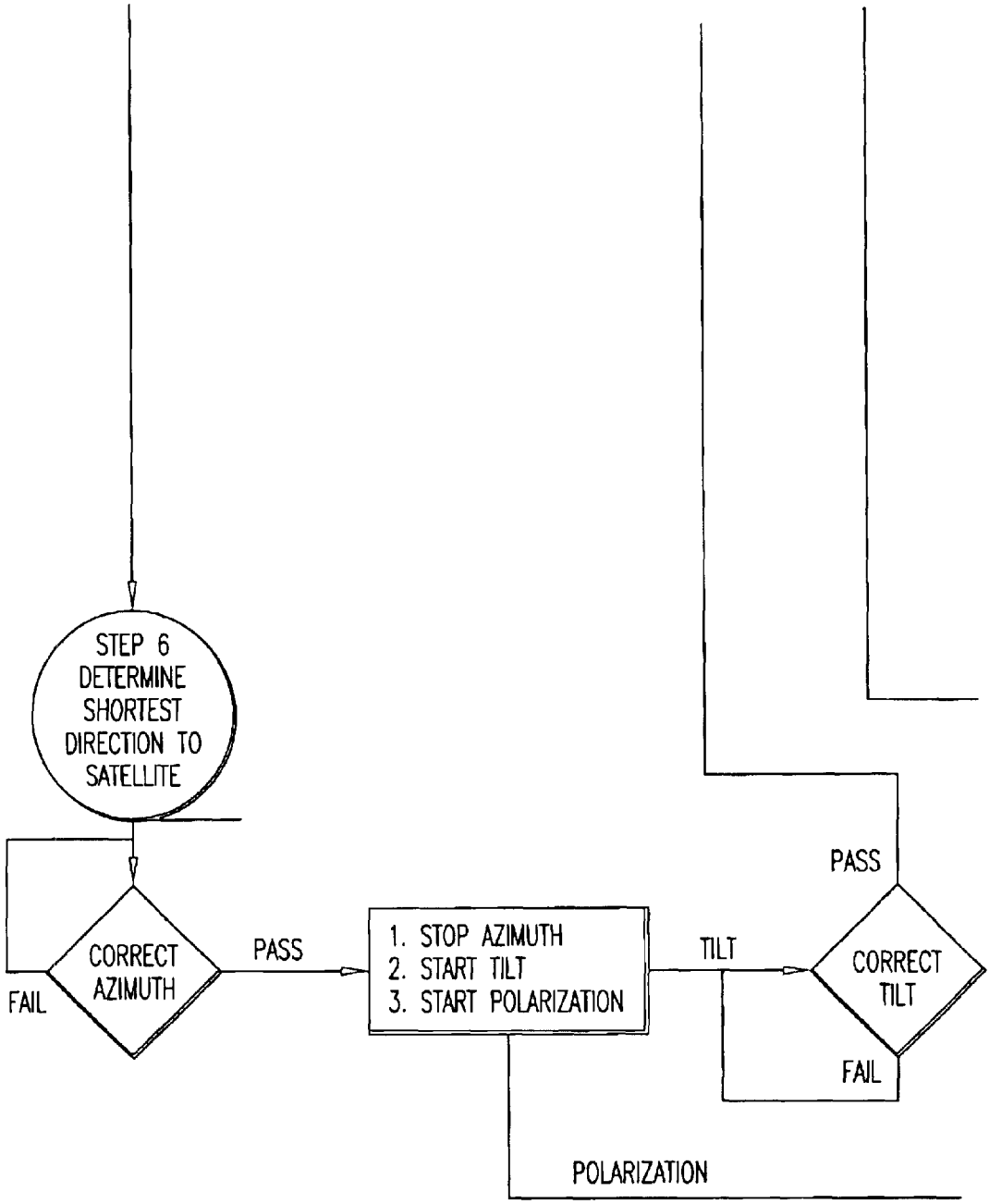
Figure 4E:
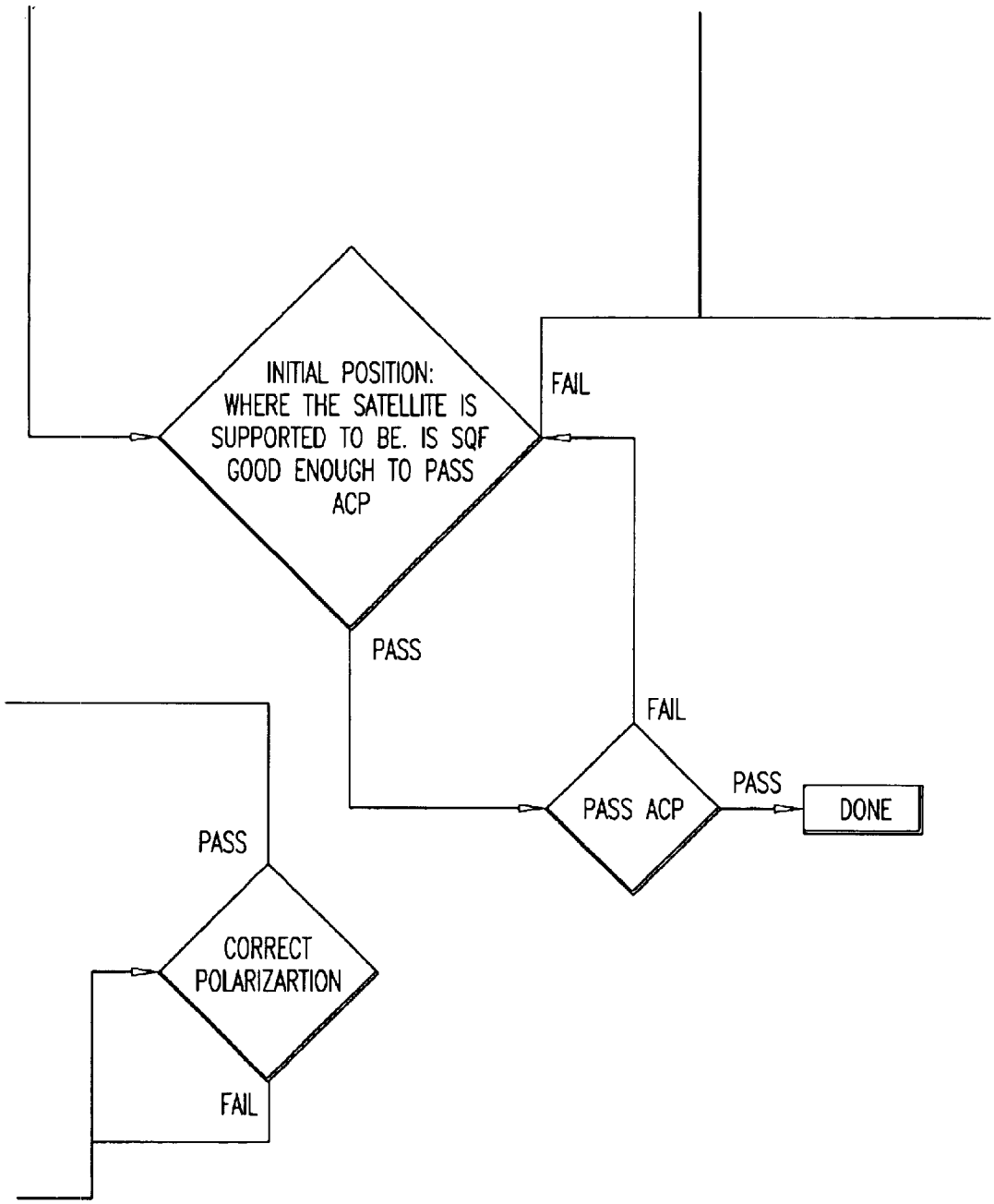
Figure 4F:
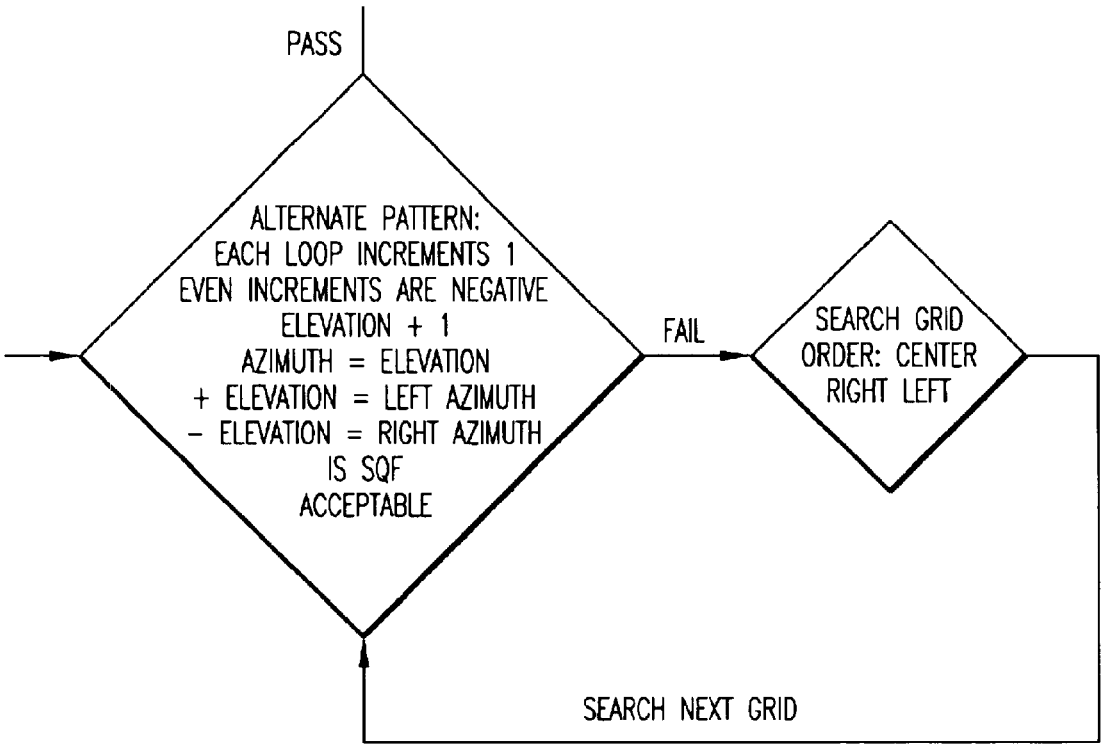

The architecture of the algorithm used to acquire a target satellite antenna is shown in FIG. 4. After the service verifies that an accurate compass reading is obtained, calculations are made to determine the azimuth, polarization, and elevation. Based on the current compass heading and the target satellite location the service will determine the shortest azimuth path to that location. Additionally, when the dish leaves the initial position azimuth readings will be taken from a mechanical device that will provide 2000 counts per 360 degree rotation. The reason for reading a mechanical device for azimuth and not the compass is because once the dish leaves the initial position (known level plane) there is no guarantee that the magnetometer will or will not yield values that are gimbaled.

When the service has completed the deploy state the next state is to move to the target satellite position. Upon reaching the target values for the azimuth, elevation and polarization the service will obtain the receive SQF and determine if the signal is sufficient to pass automatic ACP. If the signal is sufficient and automatic ACP passes, then the service will move to a wait state, but if the automatic ACP fails or the receive SQF is not high enough to pass, this will cause the service to begin a search routine. The search routine involves the receive SQF, manual ACP, automatic ACP and an efficient pattern of motor movements. The search pattern is based on a spiral model and the center of the spiral is the initial satellite target position. The service will instruct the controller to methodically move about the spiral while the service is checking the receive SQF from the modem. If at any time the receive SQF is sufficient to pass, the service will then move the modem to test the manual ACP (transmit test). The service will take four continuous samples and if two fail the service will have the modem to check for receive SQF and return to the search pattern, but if three pass then the service will move to the automatic ACP and wait for the results. If the result is a pass then the searching is finished and the service will move to a wait sate, otherwise the service will have the modem to check the receive SQF and continue searching. This pattern of searching and testing will continue through an initial target window of 20 degrees azimuth by 10 degrees elevation. If at any time automatic ACP passes then the searching is finished and the service moves to a wait state, but if the service has searched the entire window and there is no automatic ACP passing value the service will create a new search window the same size as the initial window, but this window will be −10 degrees azimuth from the initial satellite target position. The service will then search this new window using the same spiral search pattern. Once again, if there is no passing automatic ACP value then the service will create a new window the same size as the original, but the location will be +10 degrees azimuth from the initial satellite target position. This new search window will be searched with the same spiral search pattern as the previous attempts; the difference being that if no passing automatic ACP value is found the dish will stow. The average time to cover an entire search window will be approximately two minutes.

At any time if the modem passes automatic ACP the service will move to a wait state. In this state the service continues to monitor all of the devices for any activity that would cause the dish to stow. An example of such an activity would be if the GPS detected movement in the vehicle; the assumption is that the end-user is driving off and forgot to stow the dish. Since this is a hazardous situation the service will force the dish to stow. Additional actions that will cause the service to stow the dish are: receiving the stow command from the remote control, loss of communication from one of the devices and specific user input to the application software.

We claim:

1. A portable wireless self-contained signal transceiver comprising:

a) at least one directional antenna capable of both transmitting and receiving signals;

b) a robotic antenna-pointing system configured to point the at least one directional antenna at a desired communications target;

c) control communications means for accepting remote instructions from a user;

d) at least one antenna with corresponding electronics package and signal processing and signal transformation computing capability; and e) a local power supply.

2. The signal transceiver of claim 1 in which the robotic antenna-pointing system additionally comprises a self-locating subsystem and a self-leveling subsystem.

3. The signal transceiver of claim 2 in which the robotic antenna-pointing system additionally comprises a subsystem for locating a target satellite antenna using system location data and the ephemeris or ephemerides of at least one target satellite antenna.

4. The signal transceiver of claim 2 in which the robotic antenna-pointing system self-locating subsystem comprises a receiver for location information received from a system selected from the group GPS and GLONASS.

5. The signal transceiver of claim 1 in which the at least one antenna with corresponding electronics package and signal processing and signal transformation computing capability is selected from a group of types of at least one antenna with corresponding electronics package and signal processing and signal transformation computing capability consisting of RF, analog, digital, modulated voice, picture, and data.

* * * * *